US005634257A

United States Patent [19]

Kajiwara et al.

[11] Patent Number: 5,634,257

[45] Date of Patent: Jun. 3, 1997

[54] HOT STRIP ROLLING PLANT AND METHOD DIRECTLY COMBINED WITH CONTINUOUS CASTING

[75] Inventors: Toshiyuki Kajiwara, Katsushika-ku; Yasutsugu Yoshimura, Hitachi; Kenji Horii, Hitachi; Koichi Seki, Hitachi; Hironori Shimogama, Hitachi; Tadashi Nishino, Hitachi; Chukichi Hanzawa, Takahagi; Akira Goto, Hitachi, all of Japan

[73] Assignee: Hitachi, Ltd., Japan

[21] Appl. No.: 443,363

[22] Filed: May 17, 1995

[30] Foreign Application Priority Data

May 17, 1994 [JP] Japan ..... 6-102687

[51] Int. Cl.[6] ..... B21B 1/46

[52] U.S. Cl. ..... 29/527.7; 148/541; 164/417

[58] Field of Search ..... 29/527.7, 33 C; 164/417; 148/2

[56] References Cited

U.S. PATENT DOCUMENTS

| | | | |
|---|---|---|---|
| 4,798,074 | 1/1989 | Feldmann et al. . | |
| 4,885,041 | 12/1989 | den Hartog et al. . | |
| 5,009,396 | 4/1991 | den Hartog et al. . | |
| 5,150,597 | 9/1992 | Sekiya et al. | 29/527.7 X |
| 5,303,766 | 4/1994 | Kreijger et al. | 29/33 E X |
| 5,307,864 | 5/1994 | Arvedi et al. . | |
| 5,430,930 | 7/1995 | Passoni et al. | 29/33 E X |
| 5,437,089 | 8/1995 | Salganik et al. | 29/527.7 |

FOREIGN PATENT DOCUMENTS

| | | | |
|---|---|---|---|
| E 67 694B | 3/1989 | Austria . | |
| 3624241A1 | 1/1988 | Germany . | |
| 3839151A1 | 5/1990 | Germany . | |
| 4331261A1 | 4/1994 | Germany . | |
| 89502 | 4/1987 | Japan | 29/527.7 |
| 62-142004 | 6/1987 | Japan | 29/330 |

OTHER PUBLICATIONS

First Mini Mill with ISP.

Hitachi Review vol. 37, No. 4, (Aug. 1988), pp. 195–202.

"Recent Hot Strip Manufacture Techniques in Japan", (published by Japan Steel Association, Aug. 10, 1987, pp. 6–10, p. 176.

Hitachi Hyoron vol. 70, No. 6, (Jun. 25, 1988, pp. 67–72).

"Ein Jahr Beitriebserfahrung mit der CSP–Anlarge fur Warmbereitband bei Nucor Steel" (Stahl u. Eisen 111 1991) Nr. 1.

*Primary Examiner*—Carl J. Arbes

*Attorney, Agent, or Firm*—Evenson, McKeown, Edwards & Lenahan P.L.L.C.

[57] ABSTRACT

By rolling a slab with a thickness of 80 mm or less in a plant including a continuous casting machine and a hot strip rolling mill directly combined with each other, low-speed rolling can be achieved while suppressing a drop of the strip temperature and the occurrence of scales. After a slab 2 cast by a continuous casting machine 1 and being 80 mm or less thick is heated and descaled, it is rough-rolled into a bar with a thickness of 20 to 60 mm by a roughing mill 7 constructed as a 4H-twin mill. After being heated and descaled again, the bar is finish-rolled by finishing mills 19 to 21, each of which employs small-diameter work rolls having a diameter not larger than 500 mm, into a thin plate with a thickness in the range of 1.6 mm to 15 mm or a thick plate with a thickness in the range of 3 mm to 40 mm. The rolling speed on the delivery side of the finishing mills 19 to 21 is set to be as low as 350 m/minute or less with a result of small production scale, and the plant length is set to be not longer than 100 m with a result of small plant space.

48 Claims, 16 Drawing Sheets

| | |
|---|---|
| MANUFACTURING TIME | 5700 (hr/YEAR) |
| COIL WEIGHT | 20 (TONS) |
| PRODUCT PERCENTAGE | 1.6t ×1250w 10% |
| (STRIP THICKNESS t(mm) ×STRIP WIDTH w (mm)) | 2.1t ×1250w 20% |
| | 2.6t ×1550w 30% |
| | 3.1t ×1550w 20% |
| | 4.1t ×1550w 20% |

HOT STRIP ROLLING PLANT AND METHOD DIRECTLY COMBINED WITH CONTINUOUS CASTING

BACKGROUND OF THE INVENTION

1. Field of the Invention

The present invention relates to a hot strip rolling plant which performs a series of operations from continuous casting to finish rolling in a through line, and more particularly to a hot strip rolling plant and method directly combined with continuous casting, which can realize small-scale production of products with a small-scale facility.

2. Description of the Prior Arts

As described in "Recent Hot Strip Manufacture Techniques in Japan", (published by Japan Steel Association (Incorporated Body), Aug. 10, 1987), pp. 6–10 and p. 176, for example, a typical hot strip rolling plant (hereinafter referred to as a hot strip mill) is conventionally large-scaled such that a slab being 200 mm thick is rolled by one or plural roughing mills into a bar with a thickness of 20 to 40 mm, which bar is then rolled by tandem finishing mills of 6 to 7 stands. Such a hot strip mill provides a yield of 3 to 4 million tons per year and is adapted for mass production (hereinafter referred to as first prior art). A larger-scale hot strip mill provides a yield of 3 to 6 million tons per year.

Hitherto, there has naturally existed a demand for a small-scale production system in which the production scale is reduced and the plant size is also reduced correspondingly. Recent generation of iron scraps in a great deal amount has set importance on recycling of those scraps, and the concept that small-scale hot strip mills should be dispersedly installed for a convenience in collecting the scraps rather than centralizing large-scale hot strip mills, has prevailed in the world. Such a small-scale hot strip mill is simply called "mini hot". Thus, needs for optimum mini hots have become more keen.

As described in "Hitachi Hyoron Vol. 70, No. 6", (Jun. 25, 1988), pp. 67–72, for example, there is known a small-scale production system called a Steckel mill which comprises one reversible roughing mill and coiler furnaces installed upstream and downstream of the reversible mill. The steckel mill is widely employed for rolling steel strips which are less susceptible to scales, such as stainless steel plates (hereinafter referred to as second prior art).

Meanwhile, although a plate steel (hereinafter referred to as a slab) forwarded to the roughing mill is generally about 200 mm thick, recent development of a thin slab continuous casting process has succeeded in manufacturing a slab with a thickness not larger than 80 mm, e.g., about 50 mm. In some cases using such a slab, no rough rolling mills are employed and the hot strip mill is made up by a train of finishing mills only.

For example, "Ein Jahr Betriebserfahrung mir der CSP-Anlarge fur Warmbereitband bei Nucor Steel", (Stahl u. Eisen 111 (1991) Nr. 1) describes a hot strip mill utilizing the thin slab continuous casting process which intends to realize a mini hot with no roughing mills by dividing a thin slab into the length of about 40 m and rolling the divided slab after heating it and holding a heated condition. This hot strip mill employs a conventional finishing mill train comprising mills of 5 to 7 stands, shows a high rolling speed not less than 300 m/minute for the finish thickness of 2.5 mm and not less than 600 m/minute for the finish thickness of 1.6 mm on the delivery side of the finishing mill train, and has a plant length of about 250 mm (hereinafter referred to as third prior art).

Further, "First Mini Mill with ISP" intends to realize a mini hot in which a thin slab being 40 mm thick after reduction in a non-solidified state is rolled by a train of 3-stand roughing mills, an induction heater, an intermediate coiler, and 4-stand finishing mills. In this hot strip mill, a bar rolled by the roughing mills to have a thickness of 15 mm is once reeled into the form of a coil, and the coiled strip is batch-supplied to the finishing mills so that a continuous casting machine and the finishing mills are separated from each other to compensate for a large difference in speed therebetween and to maintain the strip at a required temperature. Since this hot strip mill also employs a conventional finishing mill train, it shows a high rolling speed not less than 500 m/minute on the delivery side of the finishing mill train for maintaining the strip at a required temperature, and has a plant length not less than 150 mm in spite of using the intermediate coiler (hereinafter referred to as fourth prior art).

SUMMARY OF THE INVENTION

In a typical hot strip mill of the first prior art, a finish rolling speed is from 700 to 1600 m/minute, the number of stands is so many, and hence very large motor power is required. On the other hand, an annual yield required for a mini hot is generally on the order of one million tons, and this level of annual yield can be sufficiently realized at a rolling speed as low as about 240 m/minute in theory. Consequently, it is apparent that the first prior art cannot be applied to a mini hot.

The second prior art accompanies a disadvantage that holding the strip temperature and removing surface scales are difficult to achieve at the same time. Specifically, when the hot strip mill of the second prior art is applied to plain steel strips, strip surface scales produced in the coiler furnaces must be removed by descaling jet water, which results in a problem of overly lowering the strip temperature. Since product quality has to be sacrificed as mentioned above, applications of products are limited and examples of practical use of the second prior art are few in all the world.

The third and fourth prior arts intend to realize a mini hot by using a thin slab, but employ the conventional finishing mill train and includes many stands. To avoid a drop of the strip temperature, therefore, the rolling speed on the delivery side of the finishing mill train must be at least 300 m/minute or more. In actual application, it is not rare that the rolling speed is required to be not less than about 800 m/minute. Such a high rolling speed is not in match with the continuous casting machine having a low production rate. For this reason, the current situation is that a strip is divided somewhere prior to entering the finish rolling. Conversely, if it is attempted to continuously roll a strip from the continuous casting machine to the delivery side of the finishing mill train without dividing the strip, the rolling speed in match with the annual yield required for the mini hot could be realized by reducing the rolling speed in disregard of the strip temperature. In fact, however, the strip temperature is too lowered to maintain a desired finishing temperature as a result of low-speed rolling through finishing mills of multistands. Further, a large amount of scales are produced on the strip surface and product quality satisfactory for practical use cannot be ensured.

An object of the present invention is to provide a hot strip rolling plant and method directly combined with continuous casting, which can achieve low-speed rolling by rolling a slab being 80 mm or less thick in a facility comprising a continuous casting machine and a hot strip rolling mill directly combined with each other, while preventing a drop of the strip temperature and the occurrence of scales.

To achieve the above object, according to the present invention, there is provided a hot strip rolling plant directly combined with continuous casting in which a slab cast by a continuous casting machine and having a thickness not larger than 80 mm is directly passed through a roughing mill and a finishing mill for hot rolling to produce a strip of a desired thickness, wherein a rolling mill including two sets of roll assemblies incorporated in one housing is installed as the roughing mill, and a rolling mill train of four or less stands each including small-diameter work rolls is installed as the finishing mill.

In the above hot strip rolling plant directly combined with continuous casting, preferably, the roughing mill or each stand of the finishing mill includes small-diameter work rolls with a diameter not larger than 500 mm, and the work rolls are indirectly driven by back-up rolls or intermediate rolls.

Preferably, the roughing mill is a 4 H-twin mill including two sets of 4-high roll assemblies incorporated in one roll housing, or a 2 H-twin mill including two sets of 2-high roll assemblies incorporated in one roll housing.

The above hot strip rolling plant directly combined with continuous casting, preferably, further comprises, on the entry side of the roughing mill, a first heater for heating body surfaces and edge portions of the slab over-cooled with heat radiation after casting. Preferably, the plant further comprises, on the delivery side of the first heater and on the entry side of the roughing mill, a descaler for removing scales generated on the slab surfaces during casting. Also, the distance between an outlet of the first heater and a roll biting position of the roughing mill is preferably not longer than 3 m.

The above hot strip rolling plant directly combined with continuous casting, preferably, further comprises, between the roughing mill and the finishing mill, a second heater for heating the bar cooled after rough rolling. Preferably, the plant further comprises, on the delivery side of the second heater and on the entry side of the finishing mill, a descaler for removing scales generated on bar surfaces after rough rolling. Also, the distance between an outlet of the second heater and a first roll biting position of the finishing mill is preferably not longer than 5 m.

Preferably, the finishing mill is a rolling mill for rolling the rough-rolled bar into a thin plate with a thickness not larger than 15 mm, or a thick plate with a thickness not larger than 40 mm. The plant may further comprises, downstream of the finishing mill, a cooler for cooling the strip rolled by the finishing mill, a shear for dividing the cooled strip, and a coiler such as a carrousel coiler for reeling up the divided strip into a coil, or a transfer table for feeding the divided strip to a refining yard. Preferably, the length from the continuous casting machine to the coiler or the transfer table is not larger than 100 m.

Preferably, the plant further comprises, on the delivery side of the roughing mill, a shear for severing crop portions of the bar at leading and tailing ends thereof after rough rolling and for dividing the bar.

The above finishing mill, preferably, includes a roll bending apparatus associated with at least ones of work rolls and intermediate rolls for adjusting a roll deflection to control the strip crown. In this type of finishing mill, preferably, the intermediate rolls capable of shifting in the axial direction thereof.

The above finishing mill, preferably, includes a pair of upper work roll and upper back-up roll and a pair of lower work roll and lower back-up roll, the paired rolls being crossed each other for control of the strip crown.

Preferably, the above finishing mill is a 6-high mill including work rolls, intermediate rolls and back-up rolls, at least ones of the rolls being of deformed rolls defined by contour curves which are asymmetrical about the pass center of the mill and are vertically symmetrical about a point, the deformed rolls being movable in the axial direction thereof to change a gap profile between the rolls. Alternatively, the above finishing mill is a 4-high mill including work rolls and back-up rolls, at least one of the rolls being of the deformed rolls as mentioned above.

In the above finishing mill, preferably, the work rolls are capable of shifting in the axial direction thereof so that changes in a roll gap due to wears of the work rolls are reduced.

The finishing mill is preferably a cluster mill with each of work rolls supported by a plurality of back-up rolls.

In the above finishing mill, preferably, axes of upper and lower work rolls are offset from axes upper and lower intermediate rolls or upper and lower back-up rolls toward the delivery side in the rolling direction so that driving tangential forces applied to the work rolls are canceled by horizontal components of rolling load applied to the work rolls.

In the above hot strip rolling plant directly combined with continuous casting, a roll cooler comprising a multiplicity of nozzles for ejecting cooling water toward a roll, covers for preventing the cooling water from scattering and leaking, sealing means for tightly sealing gaps between a roll surface and the covers, and recovery means for recovering the cooling water after being ejected to cool said roll is installed for each of the work rolls of at least one stand of the finishing mill.

Preferably, a roll grinder for grinding the work rolls under rolling online is installed for the work rolls of the roughing mill and at least one stand of the finishing mill.

Preferably, the descaler is a high-pressure jet descaler of rotary nozzle type for ejecting water under high pressure from rotary nozzles and removing scales, or a disk rotary grinder or a rotary brush descaler using heat-resistant brushes for mechanically removing scales.

To achieve the above object, according to the present invention, there is also provided a hot strip rolling method directly combined with continuous casting in which a slab cast by a continuous casting machine and having a thickness not larger than 80 mm is directly passed through a roughing mill and a finishing mill for hot rolling to produce a strip of a desired thickness, wherein a rolling mill including two sets of roll assemblies incorporated in one housing is employed as the roughing mill for rough-rolling the slab into a bar and, thereafter, a rolling mill train of four or less stands each including small-diameter work rolls is employed as the finishing mill for finish-rolling the bar at a high reduction rate and at a low speed.

In the above rolling method, preferably, prior to the rough rolling by the roughing mill, body surfaces and edge portions of the slab over-cooled with heat radiation after casting are heated by a first heater. Also, prior to the finish rolling by the finishing mill, the bar cooled after the rough rolling is heated by a second heater.

In the above rolling method, preferably, the rolling speed on the delivery side of the finishing mill is set to be not larger than 350 m/minute when the finishing mill comprises three stands, and not larger than 500 m/minute when the finishing mill comprises four stands.

Preferably, prior to the rough rolling by the roughing mill, scales generated on slab surfaces during casting are removed by a descaler. Also, prior to the finish rolling by the finishing mill, scales generated on bar surfaces after the rough rolling are removed by a descaler.

By constructing a series of operations from continuous casting having a low production rate to finish rolling in a through line, the finish rolling speed is reduced. This is advantageous in realizing a mini hot adapted for an annual yield on the order of one million tons that is most keenly demanded at the present. However, if the finish rolling is carried out at a low speed, the strip finishing temperature is lowered in a conventional finishing mill train of many stands. To prevent such a temperature drop, the number of stands for the finish rolling must be reduced. In order to produce a strip of the same thickness even with the reduced number of stands, the strip must be rolled at a high reduction rate in the finish rolling. In view of the above, the present invention employs a finishing mill having small-diameter work rolls, and selects the number of stands of finishing mills to four or less. As a result, the strip can be rolled at a high reduction rate, the number of stands for the finish rolling can be reduced to four or less smaller than conventional, and the strip finishing temperature can be maintained at a required level even at a low rolling speed. If the number of stands is reduced and the reduction rate is increased in the finish rolling, this necessarily leads to an increase in rolling load and power. However, consumption of energy can be saved and the plant size can be made compact by reducing the roll diameter.

In rough rolling, since the strip temperature is high and the rolling speed is as very low as 10 m/minute by being restricted by a production rate of the continuous casting machine, scales are apt to easily generate and the strip temperature is remarkably dropped by heat radiation between adjacent stands. Hence the distance between stands is required to be shortened to the utmost the roughing mill. In the present invention, therefore, the roughing mill is constructed by incorporating two sets of roll assemblies in one housing (hereinafter referred to as a twin mill), so that the distance between adjacent stands is shortened to minimize the occurrence of scales and a drop of the strip temperature.

In the present invention, since the slab thickness is set to be not larger than 80 mm, the total number of stands including the roughing mill and the finishing mills can be reduced. In addition, as mentioned above, since the roughing mill is constructed as a twin mill in which two sets of roll assemblies are incorporated in one housing, the distance between two stands of the roughing mill is shortened, and since the small-diameter work rolls are employed in each of the finishing mills to perform the finish rolling at a high reduction rate, the number of stands of the finishing mills can be reduced. As a result, the plant length can be shortened, the strip can be finish-rolled at a low speed while suppressing a drop of the strip temperature and the occurrence of scales, and hence the production scale can be made small.

Further, in the present invention, since the total number of stands can be reduced by setting the slab thickness to be not larger than 80 mm, the size of the rolling mill train can be reduced, the size of the continuous casting machine itself can be reduced, and the entire plant can be made compact. In addition, since the plant is constructed as a through line from the continuous casting machine to the hot strip rolling mill, the plant structure is simplified and the temperature of molten steel can be utilized maximally to achieve a remarkable saving in consumption of energy. Hence, the plant space can be made compact.

The term "small-diameter roll" used in the present invention means a roll having such a diameter that it cannot be directly driven. Specifically, assuming that the roll diameter is Dw and the strip width is B, the small-diameter roll has the ratio Dw/B not larger than about 0.3, and also has the roll diameter not larger than 500 mm. By employing the work rolls with a smaller diameter than conventional, i.e., 500 mm or less, in the finishing mills, not only the strip can be rolled at a higher reduction rate, but also the amount of heat absorbed by the strip can be reduced to prevent a temperature drop.

If such small-diameter work rolls are employed in the roughing mill, similar advantages are obtained. But since the slab subject to the rough rolling has a relatively large thickness, the work rolls having a diameter as small as the finishing mills are not necessarily required in the roughing mill from the viewpoint of rolling efficiency. From another viewpoint of constructing the roughing mill as a twin mill, however, it is desired to reduce the rolling load and the required torque to the utmost. Using the work rolls with a diameter of 500 mm or less smaller than convention is effective to satisfy such a demand. In addition, by using the small-diameter work rolls, the roughing mill can be made compact and, if necessary, the rough rolling can be performed at a high reduction rate.

Further, singe the finishing mills and the roughing mills employ the work rolls with a diameter of 500 mm or less smaller than convention, as mentioned above, the work rolls are indirectly driven by the back-up rolls or the intermediate rolls rather than being directly driven.

The slab cast by the continuous casting machine lowers its temperature through cooling in the casting process, and body surfaces and edge portions of the slab tends to be overly cooled with heat radiation. Therefore, such a drop of the slab temperature is compensated by the first heater disposed on the entry side of the roughing mill so that an uneven temperature distribution in the body surfaces and edge portions of the slab is made even.

Also, since the bar after the rough rolling also lowers its temperature before coming into the finish rolling, the bar is heated by the second heater disposed between the roughing mill and the finishing mills.

Scales generated on slab surfaces during casting are removed by the descaler disposed between the delivery side of the first heater and the entry side of the roughing mill. Also, scales generated on bar surfaces after the rough rolling are removed by the descaler disposed between the delivery side of the second heater and the entry side of the roughing mills.

Further, by setting the distance between the outlet of the first heater and the roll biting position of the roughing mill to be not longer than 3 m, or the distance between the outlet of the second heater and the first roll biting position of the roughing mill to be not longer than 5 m, the heated strip can be prevented from lowering its temperature before coming into the rolling, and the occurrence of scales is also prevented.

According to the hot strip rolling plant directly combined with continuous casting of the present invention, a thin plate with a thickness not larger than 15 mm and a thick plate with a thickness not larger than 40 mm can be both manufactured. After the finish rolling, the continuously rolled strip is cooled by the cooler, divided by the shear, and then reeled up by a coiler into a coil for the thin plate, or transferred to the refining yard by the transfer table, rather than being supplied to the coiler, for the thick plate.

In the present invention, since the plant is constructed as a through line from continuous casting to finish rolling without deteriorating product quality while suppressing a drop of the strip temperature and the occurrence of scales, the distance from the continuous casting machine to the coiler or the distance from the continuous casting machine to the outlet of the transfer table can be set to a length not larger than 100 mm. As a result, the plant can be made compact.

While crop portions of the bar at leading and tailing ends thereof after the rough rolling can be severed by the shear disposed on the delivery side of the roughing mill, the shear can also be used to divide the bar so that the finish rolling is performed in a batch manner.

By constructing the finishing mill as a rolling mill which includes a roll bending apparatus associated with at least ones of work rolls and intermediate rolls for adjusting a roll deflection, the strip crown can be controlled. Further, by arranging the intermediate rolls of the rolling mill to be capable of shifting in the axial direction thereof, the effect of the strip crown control is improved.

Alternatively, by constructing the finishing mill as a rolling mill which includes a pair of upper work roll and upper back-up roll and a pair of lower work roll and lower back-up roll, the paired rolls being crossed each other, the strip crown can also be controlled.

By constructing the finishing mill as a 6-high mill including work rolls, intermediate rolls and back-up rolls, at least ones of the rolls being of deformed rolls defined by contour curves which are asymmetrical about the pass center of the mill and are vertically symmetrical about a point, the deformed rolls being movable in the axial direction thereof, a gap profile between the rolls can be changed. The similar advantage can also be obtained by constructing the finishing mill as a 4-high mill which includes work rolls and back-up rolls, at least ones of the rolls being of the deformed rolls as mentioned above.

Also, by constructing the finishing mill as a rolling mill with the work rolls capable of shifting in the axial direction thereof, changes in a roll gap due to wears of the work rolls can be reduced.

Although a rolling mill with small-diameter work rolls driven indirectly accompanies a problem of horizontal flexing of the work rolls, the present invention can prevent such a problem by constructing the finishing mill as a cluster mill in which each of work rolls is supported by a plurality of back-up rolls.

Further, by constructing the finishing mill as a rolling mill in which axes of upper and lower work rolls are offset from axes upper and lower intermediate rolls or upper and lower back-up rolls toward the delivery side in the rolling direction, driving tangential forces applied to the work rolls are canceled by horizontal components of rolling load applied to the work rolls. As a result, horizontal flexing of the work rolls can be minimized.

It is supposed in the present invention that the work rolls are subject to high thermal load due to the heat applied from the hot strip and the frictional heat generated during the rolling. In the present invention, particularly since a series of operations from continuous casting to finish rolling are performed in a through line, thermal conditions are severer than in conventional batch rolling. To efficiently remove the heat applied to the work rolls, the roll cooler is installed for the work roll coming into contact with the strip. In the roll cooler, cooling water is ejected toward the work roll from a multiplicity of nozzles, the covers are provided to prevent the cooling water from scattering and leaking, the gaps between the roll surface and the covers are tightly sealed by the sealing members, and the cooling water after being ejected to cool the work roll is recovered by the recovery means.

With the roll grinder installed for the work rolls of the roughing mill and at least one stand of the finishing mill for grinding the work rolls under rolling online, the roughed surfaces of the work rolls caused by wears thereof and thermal load applied thereto can be smoothed. As a result, the exchange frequency of the work rolls can be prolonged.

In the present invention, to suppress a drop of the strip temperature as least as possible, a high-pressure jet descaler of rotary nozzle type is employed as the descaler. This makes it possible to remove scales with a smaller flow rate of water under higher pressure than in a conventional descaler using high-pressure jet water. By employing a disk rotary grinder or a rotary brush descaler using heat-resistant brushes for mechanically removing scales without resorting to water, a drop of the strip temperature can be prevented. Of course, the disk rotary grinder or the rotary brush descaler using heat-resistant brushes for mechanically removing scales may be used in cooperation with the descaler using water.

Furthermore, in the present invention, even when the rolling speed on the delivery side of the finishing mill is set to be as low as 350 m/minute for three stands of the finishing mills, or as low as 500 m/minute for four stands of the finishing mills, a drop of the strip temperature and the occurrence of scales can be prevented for the reasons as described above. As a result, the production can be made small.

DETAILED DESCRIPTION OF THE PREFERRED EMBODIMENTS

A hot strip rolling plant and method directly combined with continuous casting according to one embodiment of the present invention will be described below with reference to FIGS. 1 to 18.

Prior to entering a detailed description of the embodiment, a basic concept of the present invention will first be explained.

Figure 16:
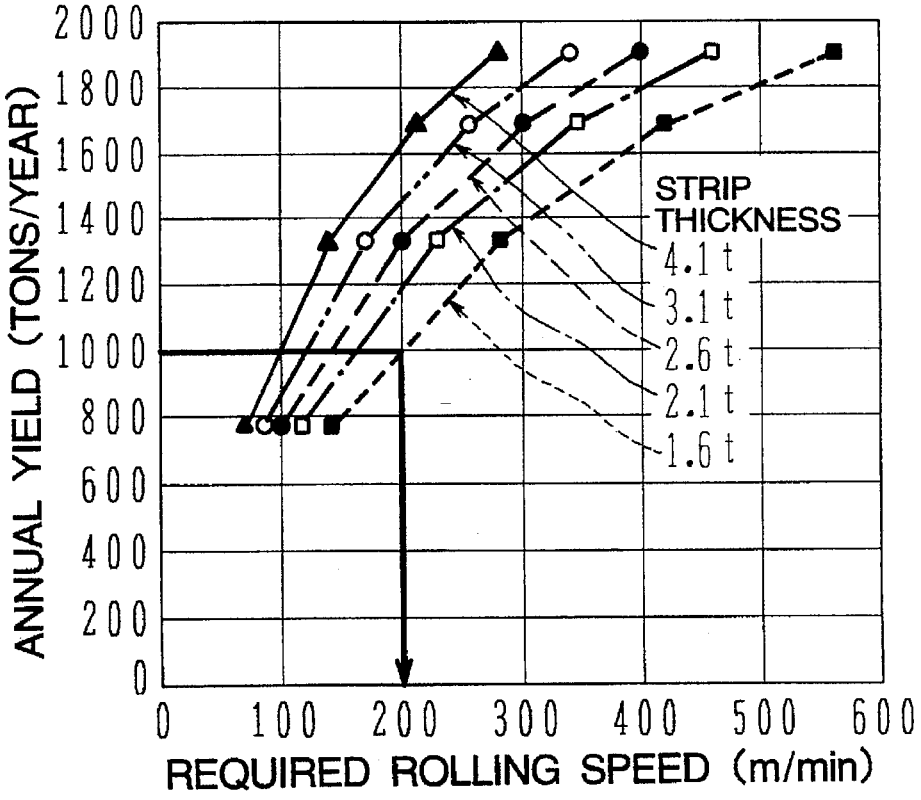
FIG. 16 is a graph showing the relationship between an annual yield of strips and a required rolling speed.

In order to realize a hot strip rolling plant (mini hot) adapted for an annual yield on the order of about one million tons that is most keenly demanded at the present, a rolling speed of about 200 m/minute is enough from the viewpoint of the relationship between an annual yield and a required rolling speed shown in FIG. 16. However, if the finish rolling is carried out at a low speed, the Strip finishing temperature would be so lowered due to heat radiation between adjacent stands and heat absorption by rolls that desired product quality could not be obtained. For this reason, conventional actual plants have been obliged to perform high-speed rolling at 800 m/minute or more.

Figure 17:
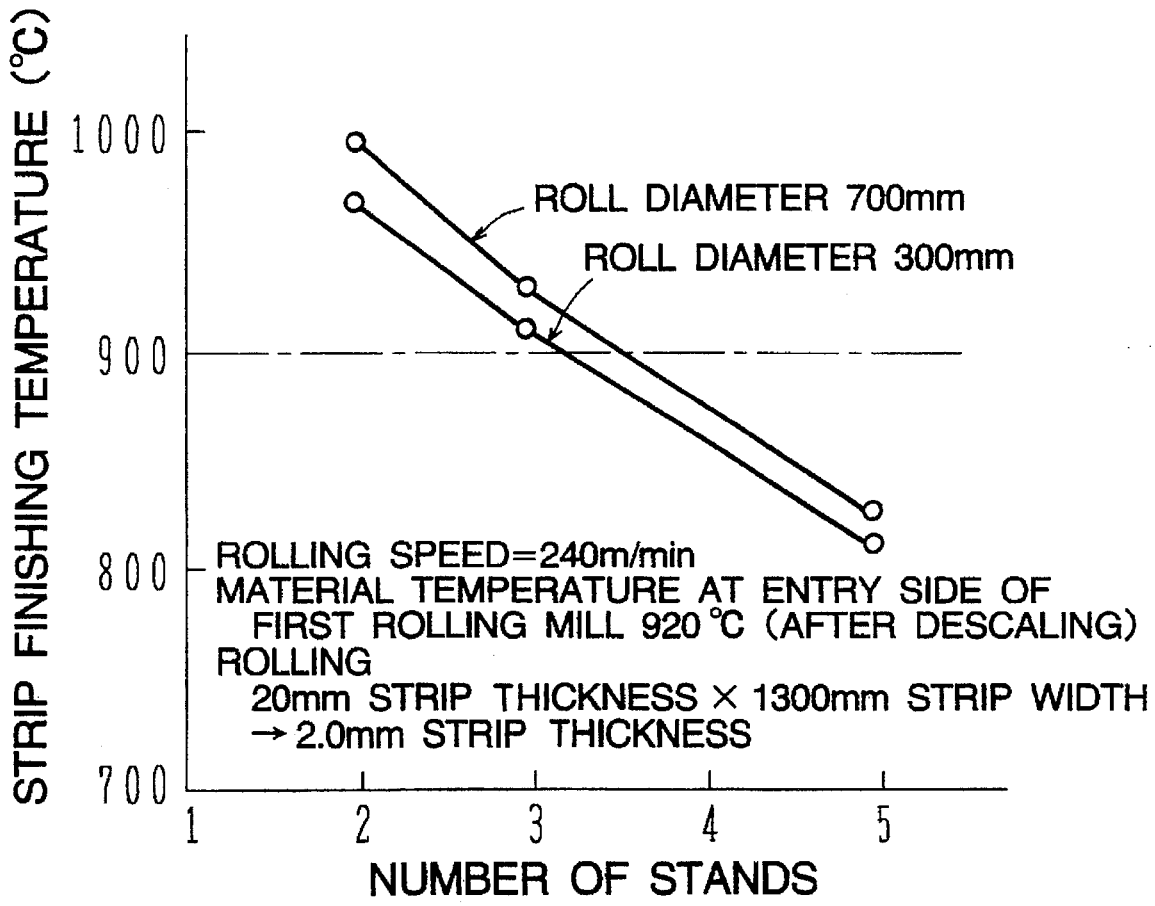
FIG. 17 is a graph showing the relationship between the number of stands of finishing mills and a strip finishing temperature.

To realize a mini hot like the present invention in which a series of operations from continuous casting to finish rolling are performed in a through line and finish rolling is carried out at a low speed, it is therefore required to prevent a drop of the strip finishing temperature by employing small-diameter rolls, carrying out finish rolling at a higher reduction rate and reducing the number of stands used in the finish rolling. As seen from calculation results shown in FIG. 17, a drop of the strip finishing temperature is suppressed by reducing the number of stands used in the finish rolling. Note that FIG. 17 shows experimental results of measuring the strip finishing temperature when a strip being 20 mm thick and 1300 mm wide was rolled into a thickness of 2.0 mm by using rolls with diameters of 700 mm and 300 mm on condition that the rolling speed was 240 m/minute and the strip temperature on the entry side of the first finishing mill (after descaling) was 920° C.

Figure 18:
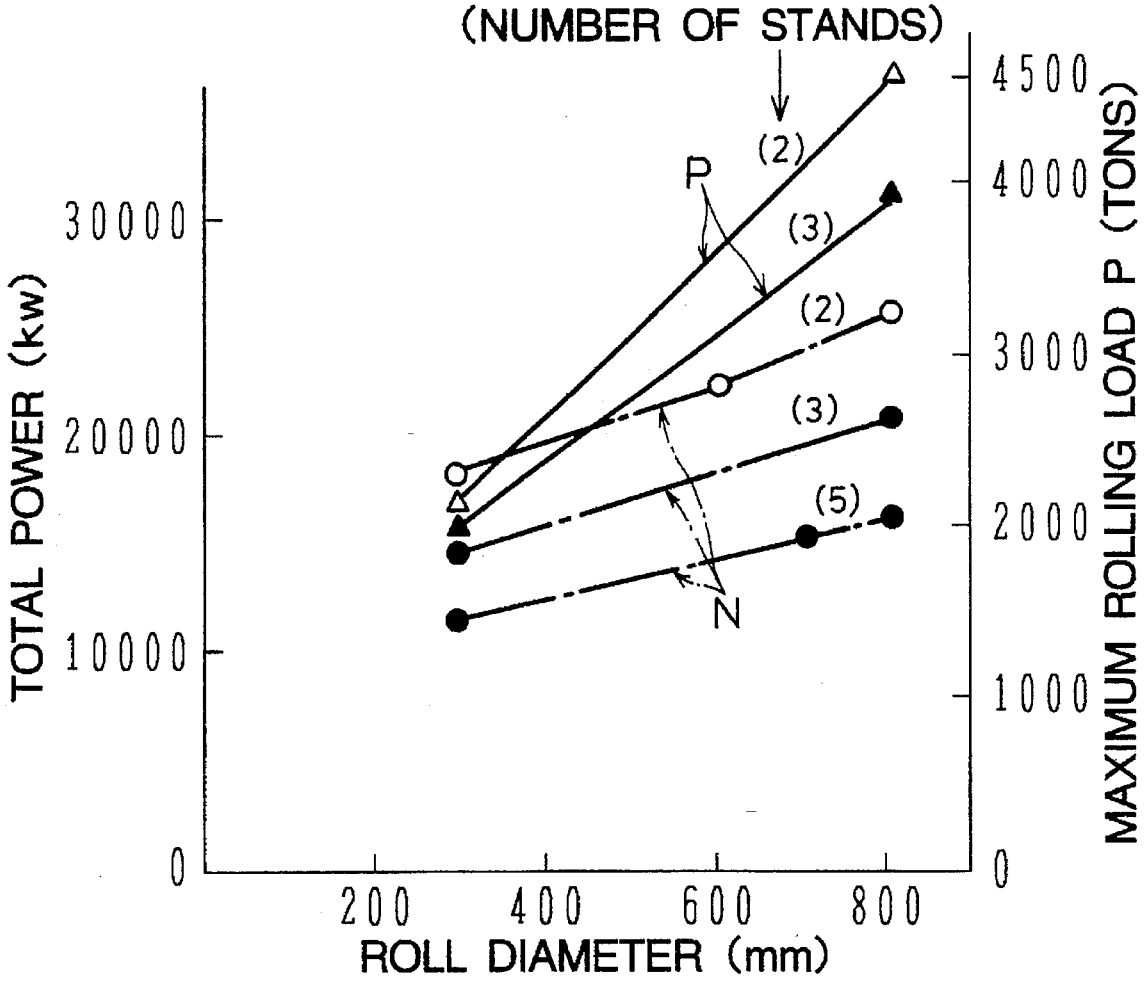
FIG. 18 is a graph showing the relationship among diameters of work rolls of the finishing mills, total power, and maximum rolling load.

If the number of stands is reduced and the reduction rate is increased in the finish rolling in view of the above, this necessarily leads to an increase in rolling load and power. As seen from calculation results shown in FIG. 18, however, the total power and the maximum rolling load can be reduced to save consumption of energy and make the plant size compact, by reducing the roll diameter. Note that FIG. 18 shows experimental results of measuring total power N (kw) (representative of rolling power) and maximum rolling load P (tons) on condition that the number of stands is set to 2, 3 and 5 and the roll diameter is changed. Additionally, a value in ( ) indicates the number of stands. For example, the rolling load P of (2) indicates the load of the stand subject to larger rolling load in the case of two stands, and the rolling load P of (3) indicates the largest load in three stands. From the above viewpoint, the present invention employs a finishing mill train of 4 or less stands each having small-diameter work rolls.

In rough rolling, since the strip temperature is high and the rolling speed is as very low as 10 m/minute by being restricted by a production rate of the continuous casting machine, scales are apt to easily generate and the strip temperature is remarkably dropped by heat radiation between adjacent stands. It is therefore desired for roughing mills to have the distance between adjacent stands as short as possible. From this viewpoint, roughing mills in the present invention are constructed as a twin mill in which two sets of roll assemblies are incorporated in one housing, so that the distance between adjacent stands is shortened to minimize the occurrence of scales and a drop of the strip temperature. By comparison, while the distance between adjacent stands is about 12 m in a conventional closed couple roughing mill using no twin mill, it can be shortened to about 1.5 m by using a twin mill as with the present invention.

In this embodiment, a thin slab with a thickness not larger than 80 mm, e.g., 70 mm, is rough-rolled into a bar having a thickness required for a finishing mill train by a roughing mill in which the distance between adjacent stands is extremely shortened, i.e., a twin mill, while suppressing a drop of the strip temperature and the occurrence of scales as least as possible. The bar is heated to 1000° to 1200° C. by a heater and is then finish-rolled by finishing mills of 4 or less stands, e.g., 3 stands, each of which has small-diameter work rolls, at a high reduction rate and at a low rolling speed not larger than 350 m/minute for the three stands or not larger than 500 m/minute for the four stands so that a desired finishing temperature is obtained. As a result, products can be continuously manufactured.

The embodiment will be described below in more detail.

Figure 1:
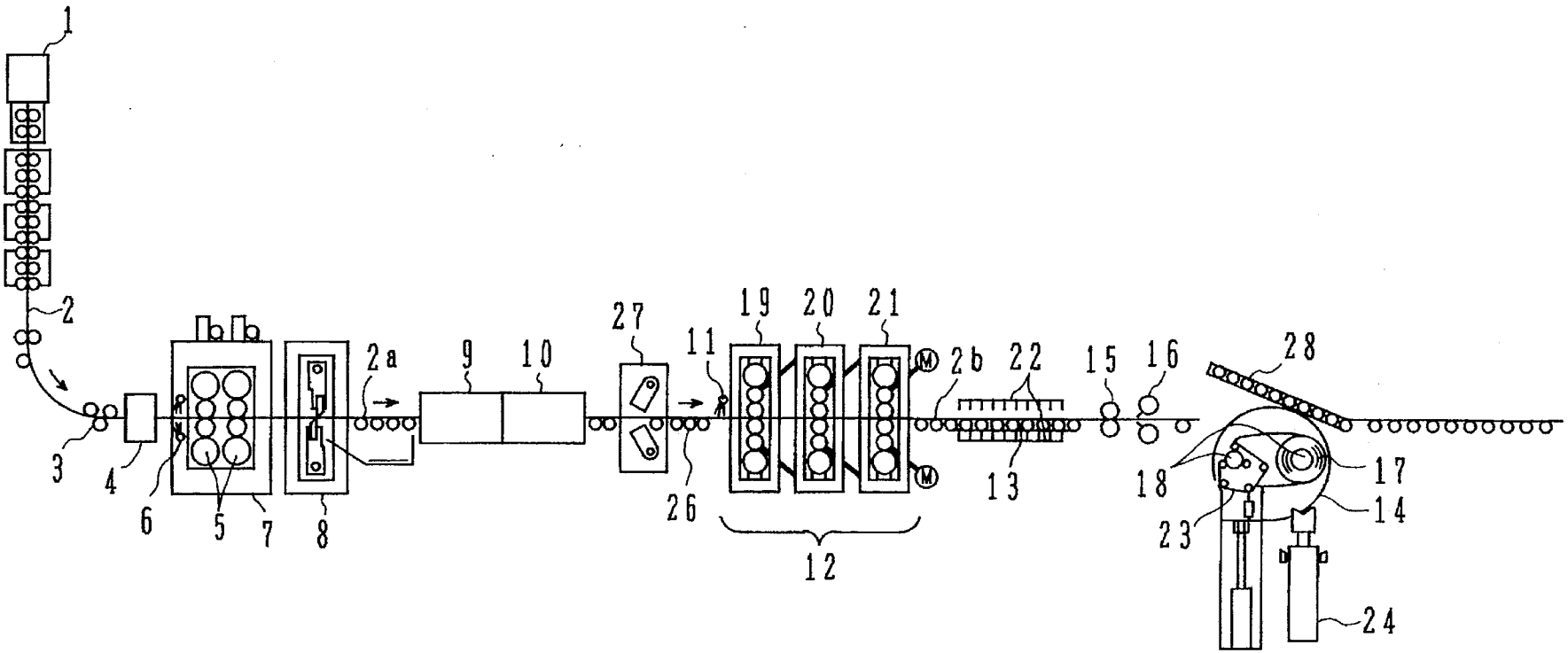
FIG. 1 is a diagram showing a schematic construction of a hot strip rolling plant combined with continuous casting according to one embodiment of the present invention, the view showing the plant for manufacturing a thin plate.

The hot strip rolling plant directly combined with continuous casting according to this embodiment comprises, as shown in FIG. 1, a continuous casting machine 1, reforming rollers 3, a roughing mill entry side heater 4 in combination of a body heater and edge heaters, a descaling apparatus 6 using high-pressure jet water, a roughing mill 7, a bar-in-passing dividing crop shear 8, an induction heater 9, an equalizing furnace 10, a bar leading end preformer 27, a descaling apparatus 11 using high-pressure jet water, a finishing mill train 12 comprised of finishing mills 19 to 21, a runout table 13, pinch rollers 15, a dividing shear 16, a carrousel coiler 14, and a transfer table 28.

A description will first be made of the case where a slab cast by the continuous casting machine is continuously rolled by using the hot strip rolling plant directly combined with continuous casting according to this embodiment to manufacture a thin plate with a thickness of 1.6 mm to 15 mm in a through line.

In FIG. 1, a slab 2 with a thickness of about 70 mm and a temperature of 1100° to 1200° C. is delivered from the continuous casting machine 1 and passes the reforming rollers 3 for correction of its curvature. The slab 2 then enters the roughing mill entry side heater 4 to compensate not only a temperature drop caused by cooling in the casting process, but also an uneven temperature distribution caused by over-cooling of body surfaces and edge portions of the slab. As a result, the slab 2 is heated to about 1200° C. and variations in its temperature are eliminated in both the directions of width and thickness thereof. Incidentally, a casting speed in the continuous casting machine 1 is in the range of about 2 to 5 m/minute.

Scales generated on the slab surface with heating and soaking by the roughing mill entry side heater 4 are removed by the descaling apparatus 6. The slab 2 deprived of surface scales is then fed to the roughing mill 7. The roughing mill 7 is a 4 H-twin mill (4-high twin roughing mill) comprising two sets of 4-high roll assemblies 5, each having small-diameter work rolls and back-up rolls, which are incorporated in one housing. The slab being about 70 mm thick is rough-rolled into a bar 2*a* with a thickness of 20 to 60 mm required for the finishing mill train 12. The rolling speed on the delivery side of the roughing mill 7 is in the range of 4 to 18 m/minute, and the temperature of the bar 2*a* is in the range of 900° to 1000° C. By contrast, the rough rolling speed in the conventional process is about 150 m/minute. The distance between an outlet of the roughing mill entry side heater 4 and a roll biting position of the roughing mill 7 is set to be not longer than 3 m. By so setting, the slab 2 heated by the roughing mill entry side heater 4 is prevented from lowering its temperature before the slab 2 comes into the rough rolling, and the occurrence of scales is also prevented. The roughing mill 7 may be constructed as a 2 H-twin mill comprising two sets of 2-high roll assemblies which are incorporated in one roll housing.

The bar 2*a* delivered from the roughing mill 7 is fed to the crop shear 8 where crop portions at front and rear ends of the slab are removed. Although this embodiment basically intends a successive process from continuous casting to finish rolling, the crop shear 8 may be used to divide the bar 2*a* into a predetermined length on the delivery side of the roughing mill 7 so that the casting process and the rolling process are separated from each other to control the casting speed and the rolling speed independently, when production schedule must be adjusted because of variations in the casting speed in the continuous casting machine 1 or the necessity of reducing the casting speed. In such a case, the crop shear 8 serves as a buffer and the finish rolling is carried out in a batch manner. Also, when a thick plate is manufactured by this embodiment (as described later), the crop shear 8 is used to divide the bar 2*a*.

The temperature of the bar 2*a* delivered from the roughing mill 7 is lowered to a level of 1000° to 900° C. that is too low for finish rolling. Therefore, the temperature of the bar 2*a* is raised to 1050° to 1200° C. by the induction heater 9. A tunnel type gas furnace may be used instead of the induction heater 9. The equalizing furnace 10 is not necessarily employed when the slab is continuously rolled.

The heated bar 2*a* having a thickness of 20 to 60 mm enters the descaling apparatus 11 for removing scales from its surface. The bar 2*a* is then fed by a transfer table 26 to the finishing mill train 12 where it is finish-rolled into a product strip 2*b* having a thickness of 1.6 to 15 mm.

The finishing mill train 12 comprises finishing mills 19, 20, 21 each having small-diameter work rolls which are driven through back-up rolls and intermediate rolls. The bar 2*a* is rolled by these 3-stand finishing mills 19, 20, 21 at a high reduction rate and at a low rolling speed. For a 4 ft mill (rolling mill adapted to roll hot strips being 4 feet wide), the finishing mills 19, 20, 21 are each a 4-high or 6-high mill having work roll with a small diameter not larger than 500 mm, e.g., on the order of 300 to 400 mm. The work rolls are indirectly driven through back-up rolls and intermediate rolls. While the finishing mills 19, 20, 21 are each illustrated as a 6-high mill in FIG. 1, a 4-high mill may be of course substituted for a 6-high mill (this equally applies to FIG. 3).

The small-diameter work rolls used in this embodiment are each formed of a roll having such a diameter that it cannot be directly driven, as mentioned above. Specifically, the ratio Dw/B of the roll diameter Dw to the strip width B is not larger than about 0.3, and the roll diameter is not larger than 500 mm. By employing the work rolls with a smaller diameter than conventional, i.e., 500 mm or less, in the finishing mills, not only the strip can be rolled at a higher reduction rate, but also the amount of heat absorbed by the strip can be reduced to prevent a temperature drop.

If such small-diameter work rolls are employed in the roughing mill 7, similar advantages are obtained. But since the slab subject to the rough rolling has a relatively large thickness, the work rolls having a diameter as small as the finishing mills 19, 20, 21 are not necessarily required in the roughing mill 7 from the viewpoint of rolling efficiency. From another viewpoint of constructing the roughing mill 7 as a twin mill, however, it is desired to reduce the rolling load and the required torque to the utmost. Using the small-diameter work rolls is effective to satisfy such a demand. In addition, by using the small-diameter work rolls, the roughing mill 7 can be made compact and, if necessary, the rough rolling can be performed at a high reduction rate.

The rolling speed on the delivery side of the finishing mill train 12 is set to a low value not larger than 350 m/minute. In spite of such a low rolling speed, a drop of the strip temperature and the occurrence of scales can be both prevented, because the finishing mills 19, 20, 21 of this embodiment each employ small-diameter rolls as the work rolls and have the number of stands reduced to three smaller than conventional, while rolling the strip at a high reduction rate. Corresponding to the transformation point of the strip, the strip temperature on the delivery side of the finishing mill train 12 is required to be kept in the range of about 820° to 920° C. This embodiment can maintain such a range of the finishing temperature.

The distance between an outlet of the induction heater 9 and a roll biting position of the first stand of the finishing mill train 12 is set to be not longer than 5 m. By so setting, the bar 2*a* heated by the induction heater 9 is prevented from lowering its temperature before the bar 2*a* comes into the finish rolling, and the occurrence of scales is also prevented.

The strip 2*b* delivered from the finishing mill train 12 is water-cooled down to a predetermined temperature by a cooler 22 installed on the runout table 13. Then, the strip 2*b* enters the pinch rollers 15 disposed on the entry side of the carrousel coiler 14, whereby a tension is applied to the strip. The strip 2*b* being rolled and fed continuously is then divided into an appropriate length by the dividing shear 16 so that it is reeled up into a coil of predetermined weight. A leading end of the divided strip 2*b* enters the carrousel coiler 14 where it is wrapped around a mandrel 18 by a chain wrapper 23. Until the strip 2*b* is wrapped around the mandrel 18 and is subject to a tension applied from the mandrel 18, the pinch rollers 15 continues applying a tension to the strip 2*b* fed from the delivery side of the finishing mill train 12. Then, the strip 2*b* is successively reeled up so as to form a coil 17. The coil 17 reeled up completely is carried out from the plant by a coil car 24.

With the process described above, hot strips can be continuously manufactured in a through line from continuous casting to finish rolling (before coiling) without dividing the strip somewhere in the line.

Figure 2A:
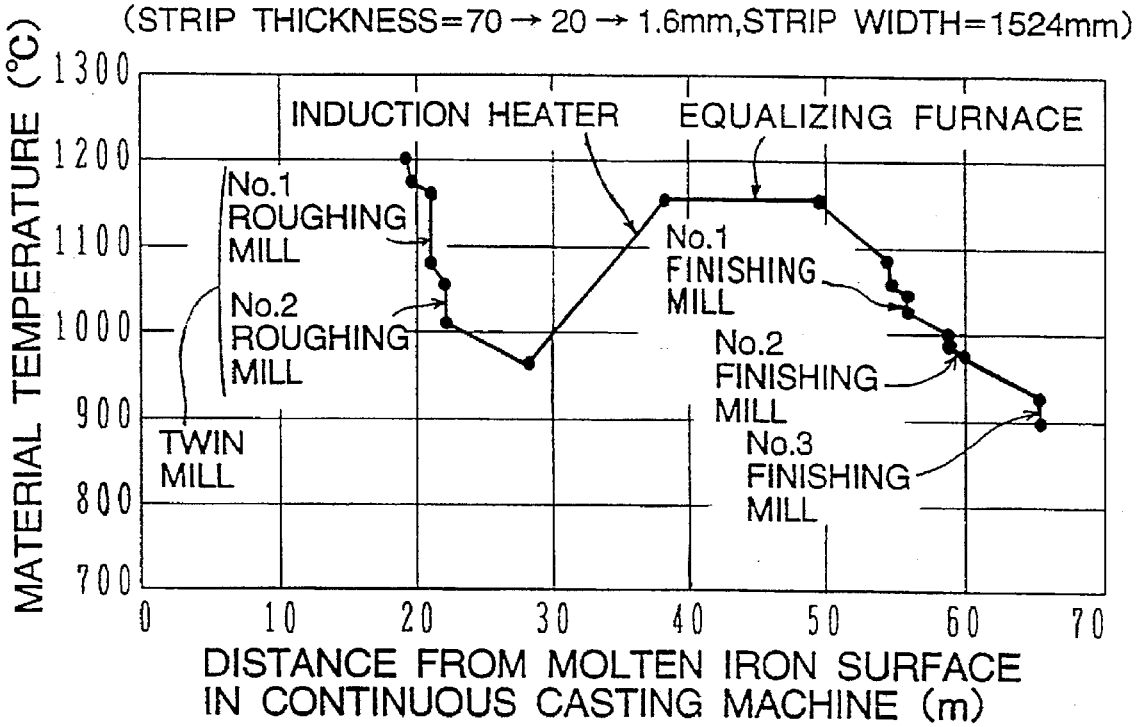
FIGS. 2A and 2B are each a graph showing an example of changes in the strip temperature resulted when a thin plate is manufactured by using the plant of FIG. 1.
Figure 2B:
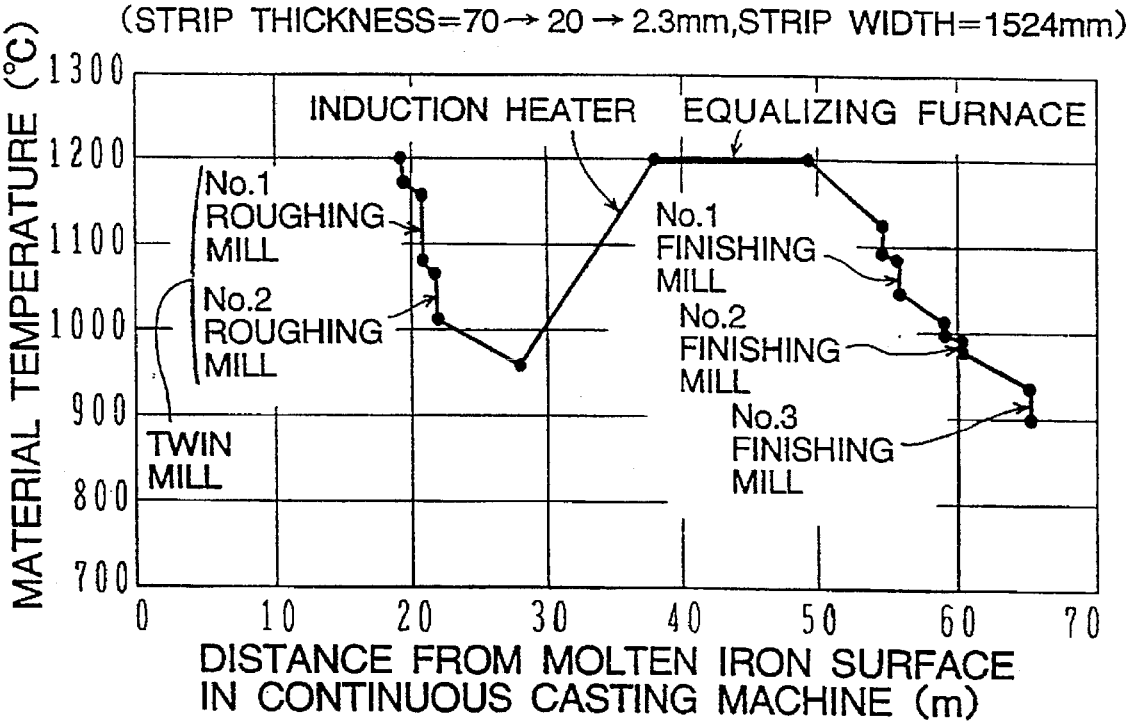

FIG. 2 shows one example of changes in the strip temperature resulted when a thin sheet is manufactured by using the above-described production process. Specifically, FIG. 2 shows temperature changes resulted when a slab being 70 mm thick was rough-rolled into a thickness of 20 mm and then finish-rolled into a desired product thickness. The horizontal axis indicates a distance (m) from the molten iron surface in the continuous casting machine. FIG. 2A represents the case where the product thickness is 1.6 mm, and FIG. 2B represents the case where the product thickness is 2.3 mm. Each of FIGS. 2A and 2B shows temperature changes from the delivery side of the roughing mill entry side heater 4 (i.e., the entry side of the descaling apparatus 6) to the delivery side of the finishing mill train 12. As seen from FIG. 2, with the hot strip rolling plant directly combined with continuous casting according to this embodiment, the rolling can be performed even at a low speed in match with the layout of the equipment and the casting speed, while ensuring the desired finishing temperature (about 900° C. in FIG. 2).

Next, a description will be made of the case where the above-mentioned hot strip rolling plant directly combined with continuous casting is used to obtain a thick plate or sheet with a thickness of 3 mm to 40 mm by rough-rolling a slab cast by the continuous casting machine, dividing a bar into a predetermined length by the crop shear 8, and then finish-rolling the divided bar.

Figure 3:
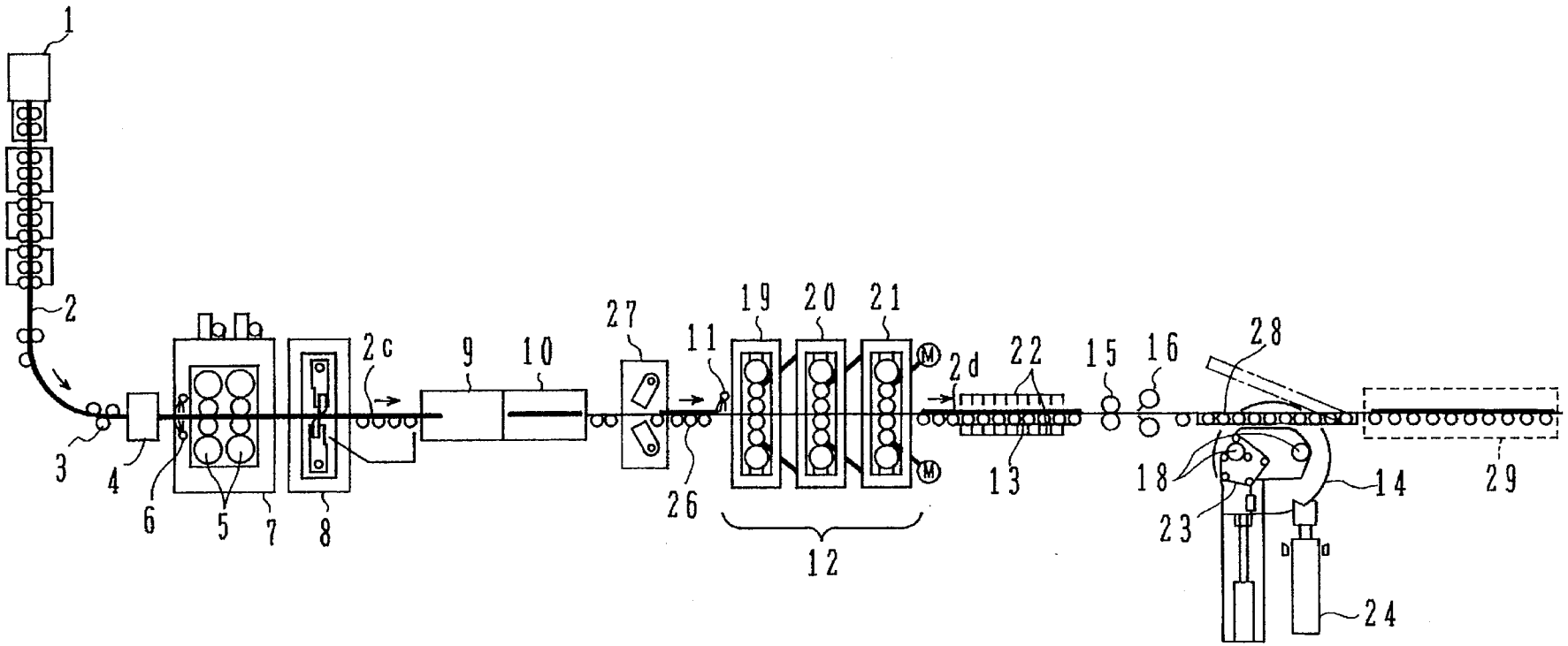
FIG. 3 is a diagram showing a schematic construction of the plant of FIG. 1 which is modified to manufacture a thick plate.

In FIG. 3, a bar 2*c* is cast and rough-rolled into a thickness of 20 mm to 60 mm in the same manner as in FIG. 1, and is then divided into a predetermined length by the bar-in-passing dividing crop shear 8 installed on the delivery side of the roughing mill 7. Thereafter, the divided bar 2*c* is heated to 1050° to 1200° C. by the induction heater 9, and its temperature distribution is made even by the equalizing furnace 10. The bar 2*c* is then fed to the finishing mill train 12 by the transfer table 26.

In this embodiment, since the finishing mills 19, 20, 21 each have the small-diameter work rolls so that the finish rolling can be made at a high reduction rate and at a low rolling speed, the work rolls are often hard to bite into the bar when a large reduction amount is required. The bar leading end preformer 27 is installed upstream of the finishing mill train 12 for the purpose of solving the above problem in biting of the work rolls. In other words, the thickness of a leading end of the divided bar 2*c* is reduced by the bar leading end preformer 27 prior to entering the finish rolling and, after that, the bar is finish-rolled by the finishing mill train 12 at a high reduction rate and at a low rolling speed.

Strip biting conditions and rolling implementing conditions after biting will now be described. These conditions are generally expressed by the following equations (1) and (2), respectively;

$$\Delta h_g=\mu^2R-P/K \quad (1)$$

$$\Delta h_r=4\mu^2R \quad (2)$$

where $\Delta h_g$ is a maximum reduction amount determined by limitations in biting, $\Delta h_r$ is a reduction amount which the strip can be rolled after it has been bitten by the rolls, $\mu$ is the coefficient of friction between a strip and a work roll, P is a rolling load, K is a spring constant of the finishing mill, and R is a radius of the work roll. From the equations (1) and (2), it is seen that $\Delta h_r$ is four or more times $\Delta h_g$. It is thus seen that whether the leading end of the strip can be satisfactorily bitten or not is important and the reduction amount is limited by the strip biting conditions. Therefore, if the leading end of the bar 2*c* is thinned by the bar leading end preformer 27 to a thickness required for the biting prior to entering the finishing mill train 12, the strip can be satisfactorily bitten even with the large reduction amount.

A strip 2*d* rolled into a product plate thickness by the finishing mill train 12 is cooled down to a predetermined temperature by the cooler 22 installed on the runout table 13. The transfer table 28 is provided such that it can be opened and closed to selectively assume a position above the carrousel coiler 14. When set above the carrousel coiler 14, the transfer table 28 can transfer the strip 2*d* to a cooling bed 29 in the refining yard. Then, the strip 2*d* is air-cooled over the cooling bed 29 and is subject to leveling or any other process, whereby a product thick plate is obtained.

The hot strip rolling plant directly combined with continuous casting according to this embodiment has the structure capable of manufacturing both a thin plate and a thick plate as described above. In other words, with this embodiment in which the finishing mill train 12 comprises three stands as shown in FIGS. 1 and 3, product strips with a thickness of about 1.6 mm to 40 mm, including a thin plate and a thick plate, can be manufactured at a low finish rolling speed not larger than 350 m/minute. Taking into account the rolling speed and the strip thickness, the finishing mill train may comprise four stands. In this case, the finish rolling speed can be set to 500 m/minute or less and product strips with a thickness of about 1.2 mm to 15 mm can be manufactured.

With this embodiment, since a series of operations from continuous casting to finish rolling with no deterioration in product quality while preventing a drop of the strip temperature and the occurrence of scales, it is possible to set the smaller distances between adjacent equipment than conventional; e.g., the distance from the continuous casting machine 1 to nearly the middle of the roughing mill 7 is not longer than about 10 to 15 m, the distance from the roughing mill 7 to the entry side of the finishing mill train 12 is not longer than about 30 to 45 m, the distance from the entry side to the delivery side of the finishing mill train 12 is not longer than about 10 to 15 m, and the distance subsequent to the finishing mill train 12 is not longer than about 30 to 45 m. Thus, the equipment can be arranged such that the distance from the continuous casting machine 1 to the carrousel coiler 14 or the distance from the continuous casting machine 1 to the outlet of the transfer table 28 can be set to a length not larger than 100 mm. As a result, the plant can be made compact.

Additionally, the delivery side speed of the continuous casting machine 1, the delivery side speed of the roughing mill 7, and the delivery side speed of the finishing mill train 12 can be matched with each other by controlling respective rolling speeds, i.e., roll driving speeds, of the roughing mill 7 and the finishing mills 19, 20, 21 of the finishing mill train 12.

Next, a description will be made of rolling mills which are applicable to the finishing mills 19, 20, 21 in FIGS. 1 and 3.

Figure 4:
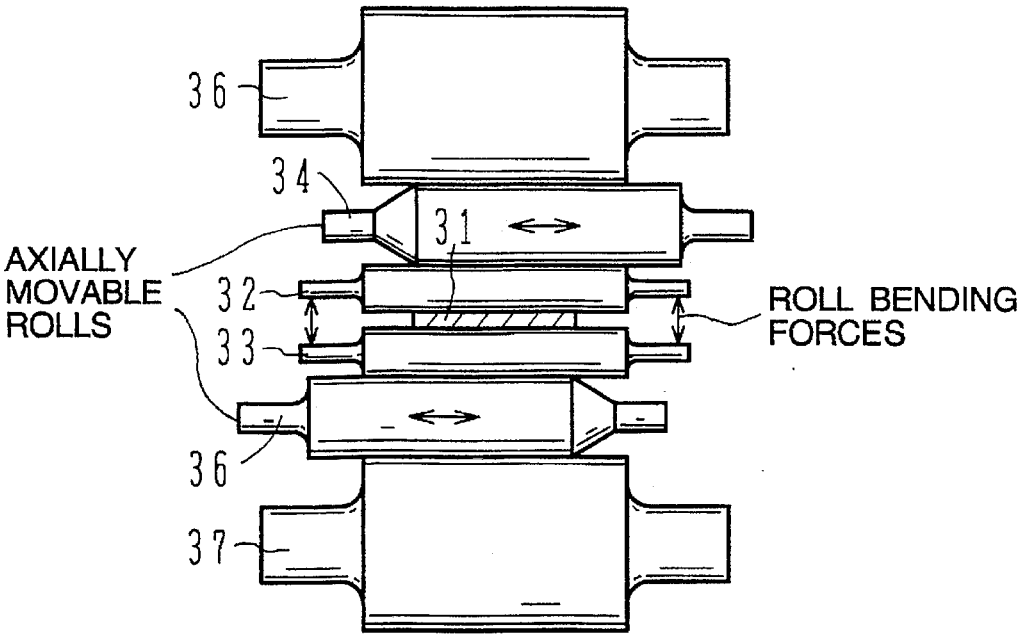
FIG. 4 is a view showing a 6-high mill with intermediate rolls capable of shifting, as one example of rolling mills applicable to each of finishing mills in FIG. 1 or 3.

As one example, a 6-high mill with intermediate rolls capable of shifting, as shown in FIG. 4, can be applied to the finishing mill. The 6-high mill shown in FIG. 4 comprises a pair of upper and lower work rolls 32, 33, a pair of upper and lower intermediate rolls 34, 35, and a pair of upper and lower back-up rolls 36, 37. By moving the intermediate rolls 34, 35 in the axial direction thereof and applying bending forces to the work rolls 32, 33 in a combined manner, the thickness distribution of a strip 31 in the transverse direction thereof is controlled so as to control the crown and shape (flatness) of the strip 31. In this type of rolling mill, the intermediate rolls 34, 35 are movable in the axial direction thereof and are supported by the back-up rolls 36, 37, respectively.

Note that the rolling mill is not limited to the above-described type axially moving the intermediate rolls and, as an alternative, it may be of the type axially moving the work rolls or the type axially moving the back-up rolls. In addition, bending forces may be applied to the intermediate rolls for an improved ability of crown control.

Figure 5:
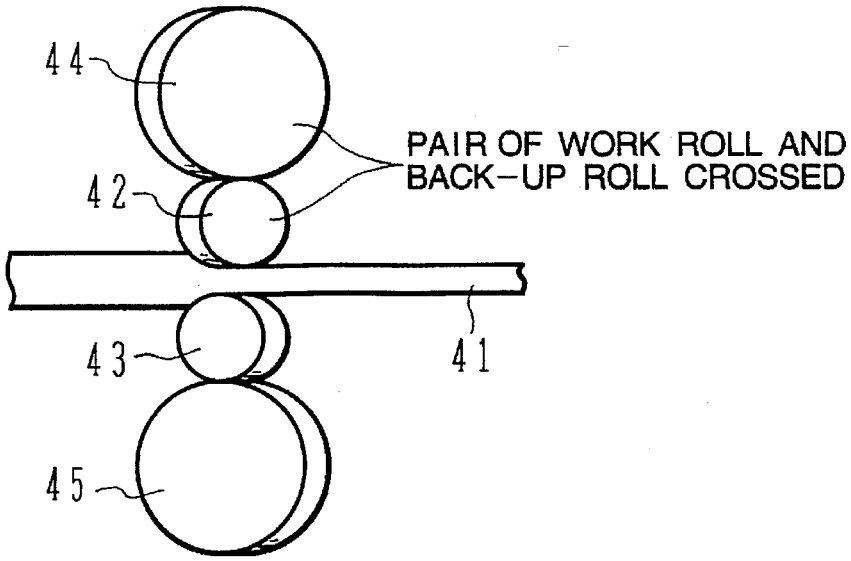
FIG. 5 is a view showing a 4-high mill with rolls crossed with each other, as one example of rolling mills applicable to each of finishing mills in FIG. 1 or 3.

As another example, a 4-high mill with each pair of rolls crossed each other, as shown in FIG. 5, can be applied to the finishing mill. Recently, such a mill with each pair of rolls crossed with each other for control of the strip crown has been widely used. The 4-high mill shown in FIG. 5 comprises a pair of upper and lower work rolls 42, 43 and a pair of upper and lower back-up rolls 44, 45 respectively supporting the work rolls 42, 43. A pair of the work roll 42 and the back-up roll 44 and a pair of the work roll 43 and the back-up roll 45 are arranged such that the paired rolls are crossed with each other in a horizontal plane. This cross arrangement is also effective to control the strip crown and shape of a strip 41. This type of rolling mill can be realized by employing the back-up rolls which are driven.

Figure 6:
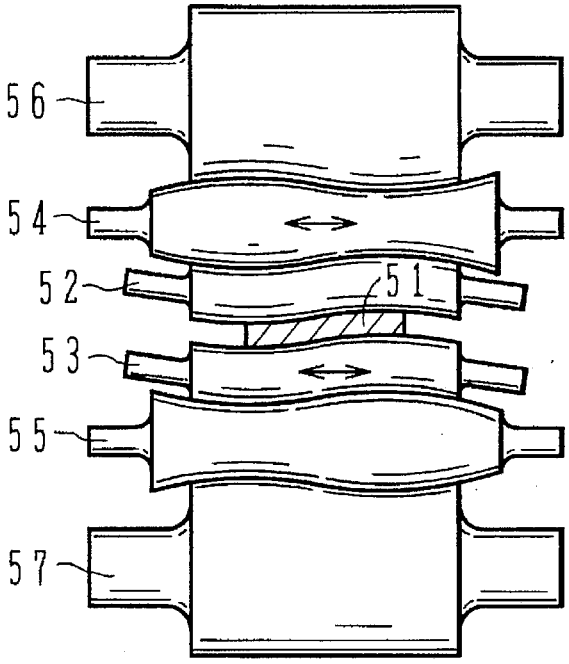
FIG. 6 is a view showing a 6-high mill including deformed or bottle-shaped rolls, as one example of rolling mills applicable to each of finishing mills in FIG. 1 or 3.
Figure 7:
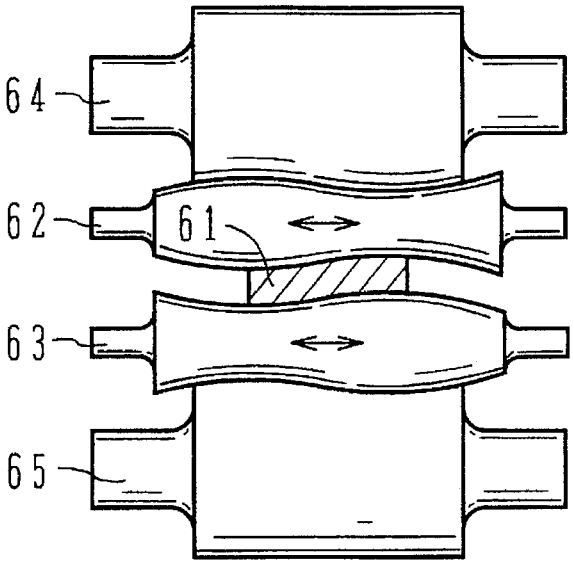
FIG. 7 is a view showing a 4-high mill including deformed or bottle-shaped rolls, as one example of rolling mills applicable to each of finishing mills in FIG. 1 or 3.

As still another example, a rolling mill using deformed (bottle-shaped) rolls, as shown in FIG. 6 or 7, can be applied to the finishing mill. This type of rolling mill with rolls having a bottle-shape crown has recently been developed, and is also effective to control the crown and shape of a strip. The rolling mill shown in FIG. 6 is a 6-high mill comprising a pair of upper and lower work rolls 52, 53, a pair of upper and lower intermediate rolls 54, 55 having bottle-shaped crowns mutually symmetrical about a point, and a pair of upper and lower back-up rolls 56, 57. The bottle-shaped intermediate rolls 54, 55 are movable in the axial direction thereof. The transverse thickness distribution of a strip 51 is controlled by moving the intermediate rolls 54, 55 in opposite directions to each other. In this type of rolling mill, rather than that shown in FIG. 6, ones of the work rolls and the back-up rolls, or both the work rolls and the back-up rolls, or all the work rolls, intermediate rolls and the back-up rolls may be formed of the bottle-shaped rolls as mentioned above.

On the other hand, the rolling mill shown in FIG. 7 is a 4-high mill comprising a pair of upper and lower work rolls 62, 63 having bottle-shaped crowns mutually symmetrical about a point and a pair of upper and lower back-up rolls 64, 65. The bottle-shaped work rolls 62, 63 are movable in the axial direction thereof. The transverse thickness distribution of a strip 61 is controlled by moving the work rolls 62, 63 in opposite directions to each other. In this type of rolling mill, rather than that shown FIG. 7, only the back-up rolls or both the work rolls and the back-up rolls may be formed of the bottle-shaped rolls as mentioned above.

Figure 8:
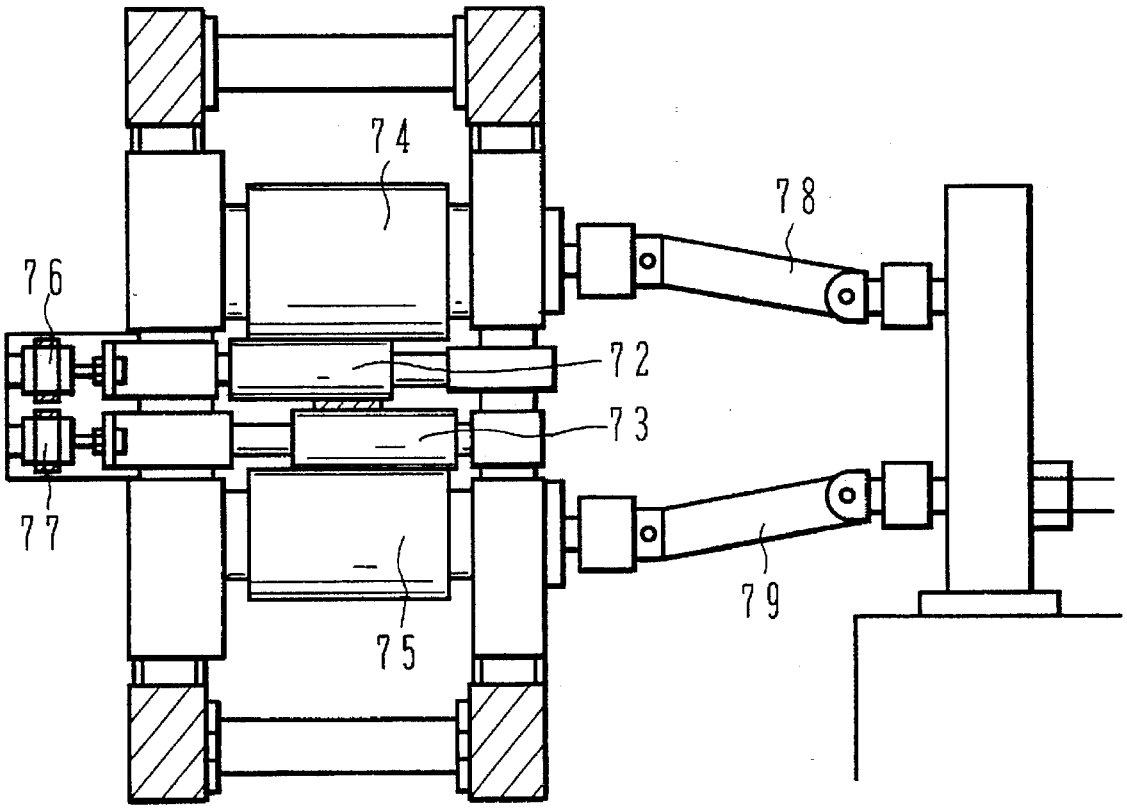
FIG. 8 is a view showing a rolling mill with work rolls capable of shifting, as one example of rolling mills applicable to each of finishing mills in FIG. 1 or 3.

As still another example, a rolling mill with work rolls capable of shifting, as shown in FIG. 8, can be applied to the finishing mill. The rolling mill shown in FIG. 8 is a 4-high mill comprising a pair of upper and lower work rolls 72, 73 and a pair of upper and lower back-up rolls 74, 75. The work rolls 72, 73 are movable in the axial direction thereof by respective shift mechanisms 76, 77 each comprising a cylinder or the like, so that wears of the work rolls caused by rolling are dispersed and changes in the roll gap depending on the wears are kept small. In this type of rolling mill, the back-up rolls 74, 75 are driven by a motor (not shown) through spindles 78, 79, respectively.

The above finishing mills shown in FIGS. 4 to 8 intend to compensate insufficiency in control of the strip crown and shape due to a lack of flexing rigidity of the small-diameter work rolls.

Figure 9:
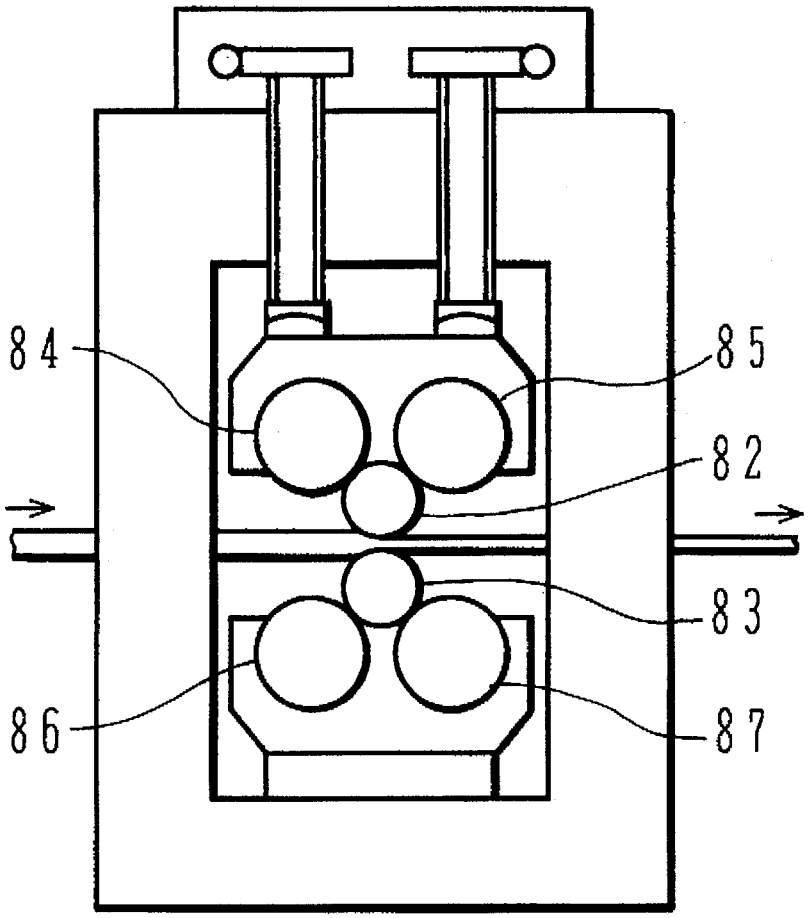
FIG. 9 is a view showing a cluster mill with each of work rolls supported by a plurality of back-up rolls, as one example of rolling mills applicable to each of finishing mills in FIG. 1 or 3.

As still another example, a cluster mill with each work roll supported by a plurality of back-up rolls, as shown in FIG. 9, can be applied to the finishing mill. In the cluster mill shown in FIG. 9, a pair of upper and lower work rolls 82, 83 are each supported by a plurality of back-up rolls 84, 85; 86, 87. While the rolling mill using the small-diameter work rolls indirectly driven accompanies a problem of horizontal flexing of the work rolls, such a problem is prevented in this type of cluster mill by using the plurality of back-up rolls 84, 85; 86, 87 to support respective work rolls.

Figure 10:
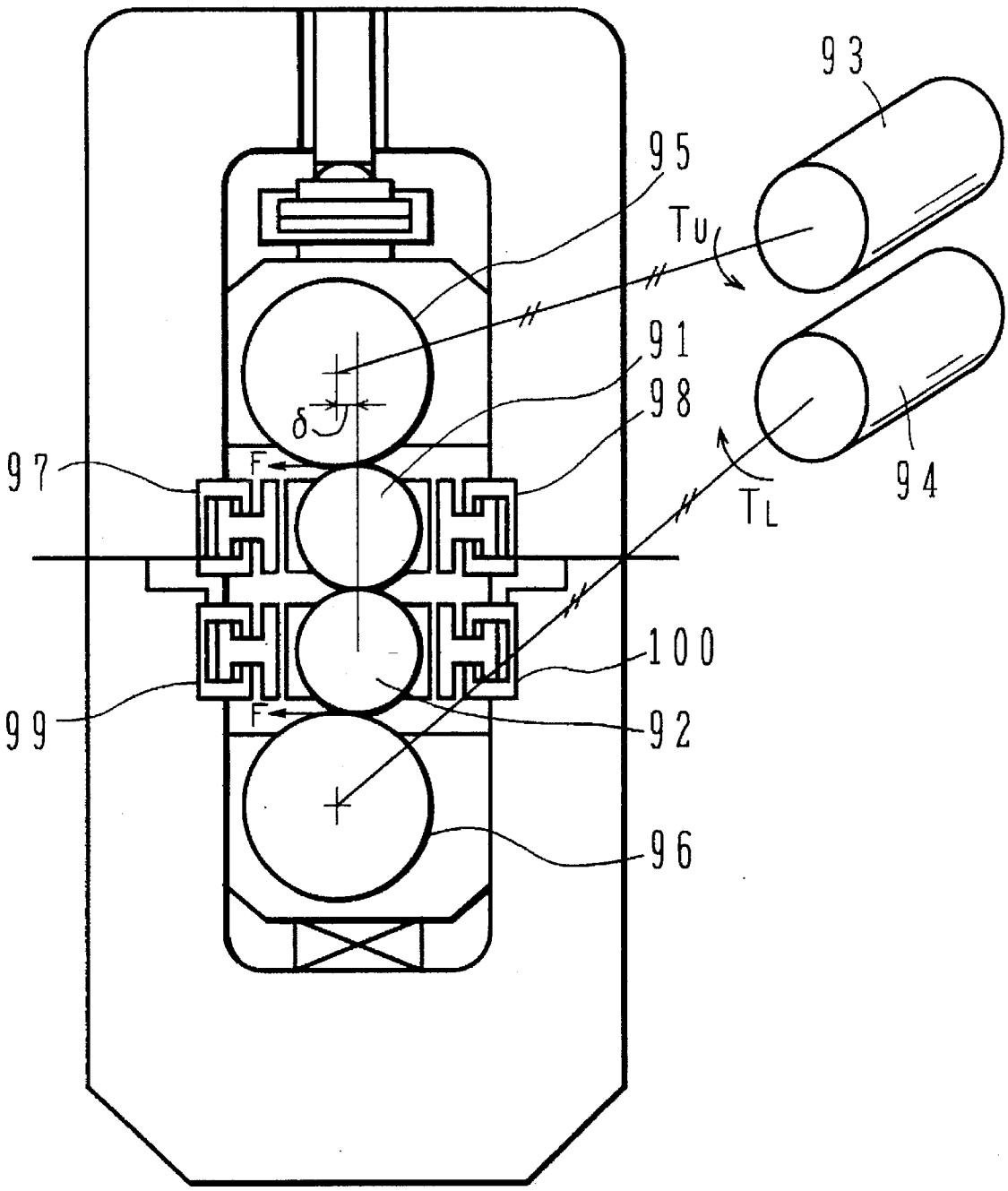
FIG. 10 is a view showing a rolling mill with work rolls offset in the rolling direction relative to axes of back-up rolls, as one example of rolling mills applicable to each of finishing mills in FIG. 1 or 3.

As still another example, a rolling mill with work rolls offset in the rolling direction relative to axes of back-up rolls, as shown in FIG. 10, can be applied to the finishing mill. The rolling mill shown in FIG. 10 is a 4-high mill comprising a pair of upper and lower work rolls 91, 92 and a pair of upper and lower back-up rolls 95, 96 driven by respective motors 93, 94. The work rolls 91, 92 are offset respectively by cylinders 97, 98, 99, 100 in the rolling direction relative to axes of the back-up rolls 95, 96.

An offset amount 6 of each of the work rolls 91, 92 is adjusted so that driving tangential forces F of the work rolls 91, 92 determined from rolling torque (the sum of torque $T_U$ of the motor 93 and torque $T_L$ of the motor 94) of the motors 93, 94 for driving the back-up rolls 95, 96, respectively, are essentially balanced by horizontal components of the rolling load produced with the offsets of the work rolls 91, 92. The offset amount $\delta$ is variably adjusted depending on the rolling conditions. In this type of offset rolling mill, the driving tangential forces F applied to the work rolls 91, 92 can be lessened by the horizontal components of the rolling load produced with the offsets of the work rolls 91, 92, and hence horizontal flexing of the work rolls 91, 92 can be minimized. Further, the diameter of the work rolls 91, 92 can be made small with no need of auxiliary equipment around roll barrels.

The rolling mills shown in FIGS. 9 and 10 intend to solve the problem of horizontal flexing that is apt to easily occur when the small-diameter work rolls are used.

The roll cooler installed for the finishing mills 19, 20, 21 shown in FIGS. 1 and 3 will be described below with reference to FIG. 11.

It is supposed that the work rolls are extremely heated because of high thermal load due to the heat applied from the hot strip held at nearly 1000° C. and the frictional heat generated from biting portions of the rolls during the rolling. In this embodiment, particularly since a series of operations from continuous casting to finish rolling are performed in a through line, thermal conditions are severer than in conventional batch rolling.

Figure 11:
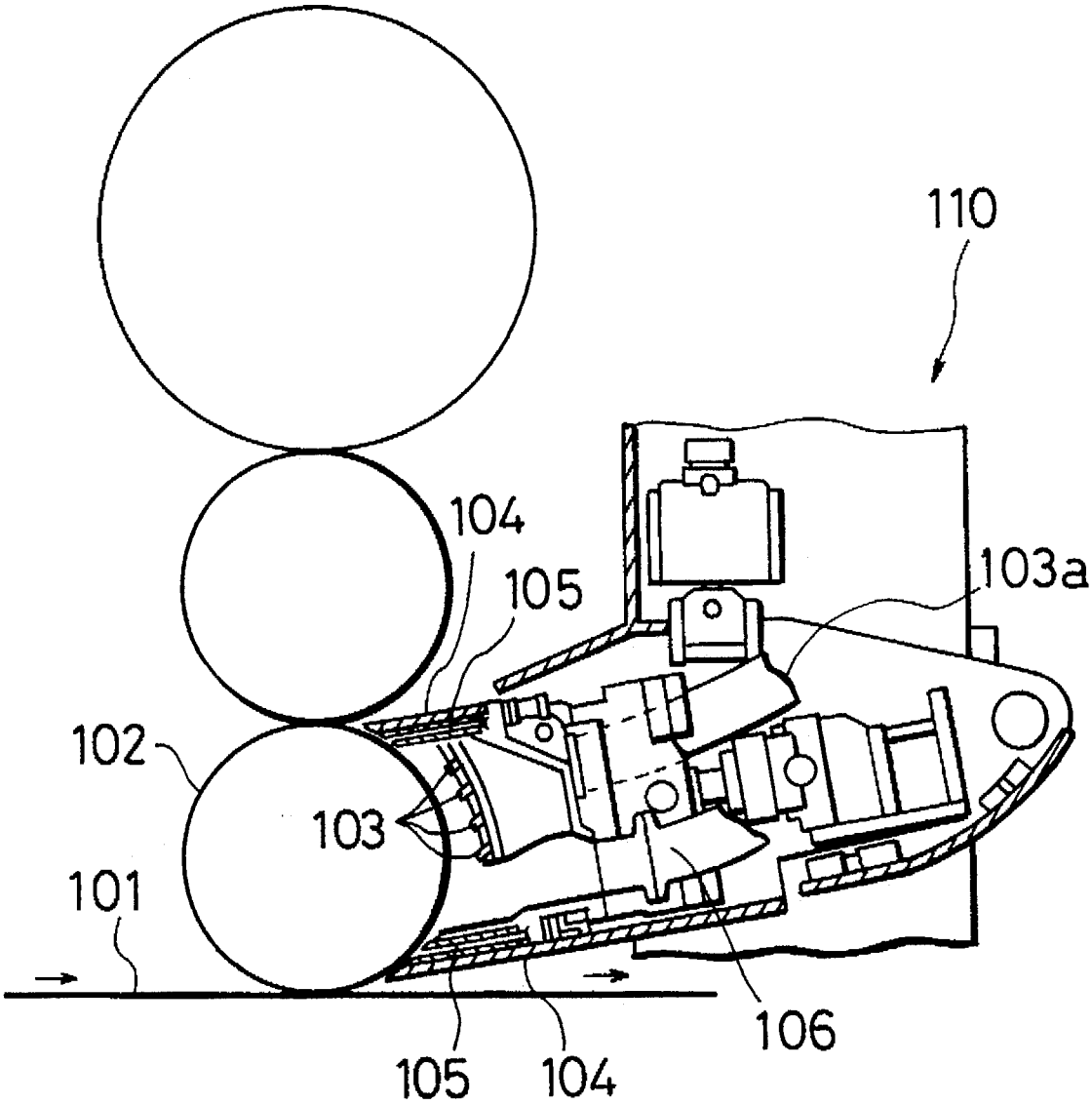
FIG. 11 is a sectional view showing a roll cooler which is installed for each of the finishing mills in FIGS. 1 and 3.

To efficiently remove the heat applied to the work rolls, a multinozzle type roll cooler 110 constructed as shown in FIG. 11, for example, is installed for the work roll coming into contact with the strip. In the roll cooler 110, cooling water is supplied from a water feed pipe 103*a* to a multiplicity of nozzles 103 from which the cooling water is ejected toward a work roll 102. At this time, it is required not only to prevent a strip 101 itself from lowering its temperature as least as possible, but also prevent guides, metal chocks or projecting blocks of the mill from corroding with the cooling water splashed over them. To this end, the roll cooler 110 includes covers 104 for preventing the cooling water from scattering and leaking, sealing members 105 for tightly sealing the gaps between the surface of the work roll 102 and the covers 104, and a recovery port 106 for recovering the cooling water after being ejected to cool the work roll. While the water cooler 110 can be installed for any of the finishing mills 19, 20, 21, it is preferably installed for each of the finishing mills.

Next, one example of roll grinders installed for the roughing mill 7 and the finishing mills 19, 20, 21 in FIGS. 1 and 3 will be described with reference to FIG. 12.

Figure 12:
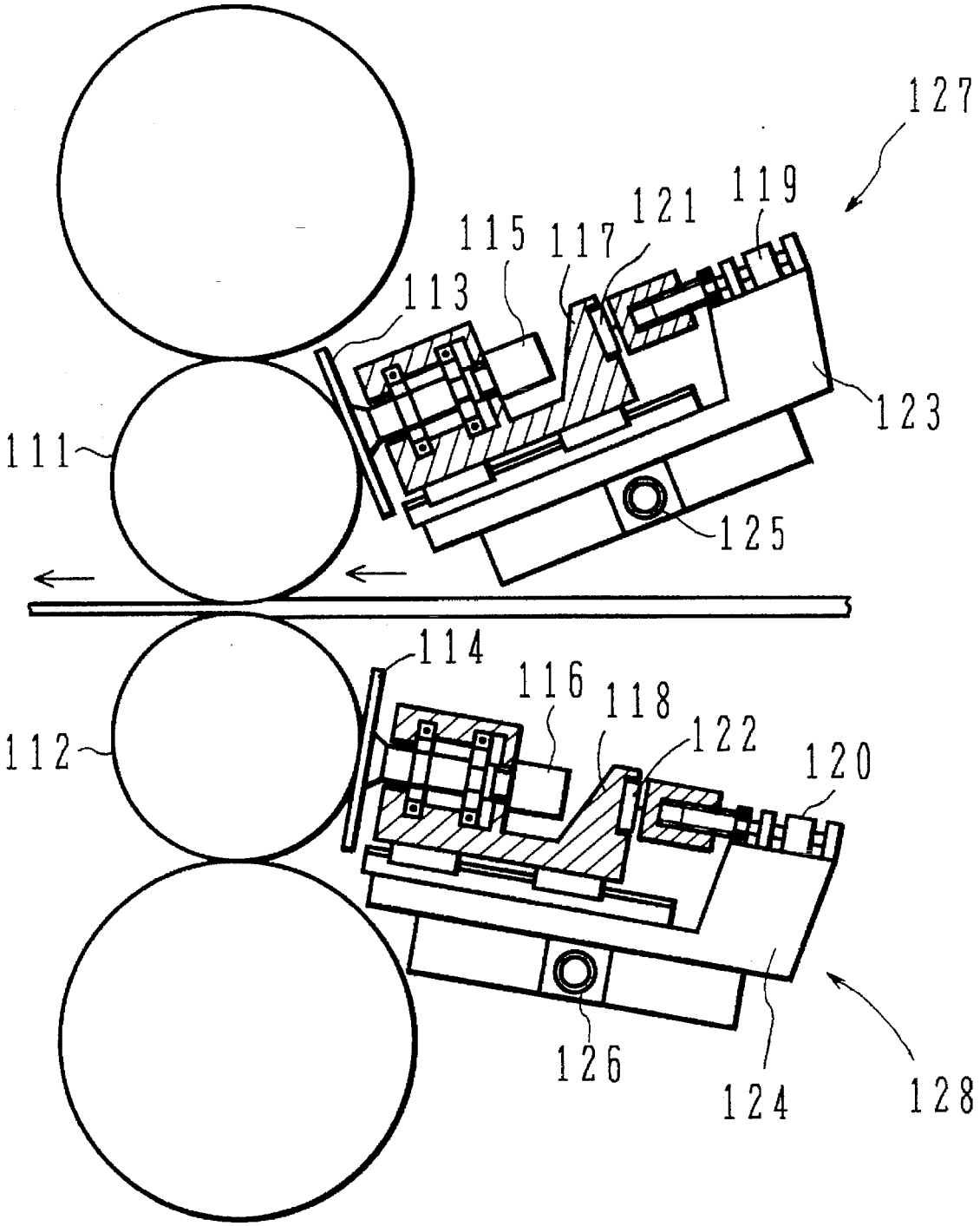
FIG. 12 is a sectional view showing a roll grinder which is installed for each of the finishing mills in FIGS. 1 and 3.

A roll grinder shown in FIG. 12 is of the so-called roll shaving machine (RSM) for grinding work rolls 111, 112 under rolling online. In roll shaving machines 127, 128 shown in FIG. 12, disk-shaped grinding whetstones 113, 114 are driven by respective hydraulic motors 115, 116 to rotate about their axes, and are pressed against the work rolls 111, 112 by pushing whetstone headers 117, 118 upon energization of motors 119, 120, respectively. Pressing forces of the grinding whetstones 113, 114 are controlled while measuring the forces by load cells 121, 122. The grinding whetstones 113, 114, the hydraulic motors 115, 116, the whetstone headers 117, 118, the motors 119, 120, and the load cells 121, 122 are attached respectively to frames 123, 124. The pressing directions of the grinding whetstones 113, 114 are adjusted by rotating the frames 123, 124 about respective shafts 125, 126.

The roll shaving machines 127, 128 can smooth the roughed surfaces of the work rolls 111, 112 caused by roll wears or thermal load, thereby prolonging the exchange frequency of the work rolls 111, 112. Also, a roll profile can be measured by detecting the pressing forces and positions of the grinding whetstones 113, 114 in the roll shaving machines 127, 128. Therefore, control of the strip crown, i.e., control of roll bending forces, can be performed based on the measured results. The roll shaving machines 127, 128 can be installed for the work rolls of any of the roughing mill 7 and the finishing mills 19, 20, 21.

A description will now be made of a descaler applicable to the descaling apparatus 6, 11 in FIGS. 1 and 3.

Figure 13:
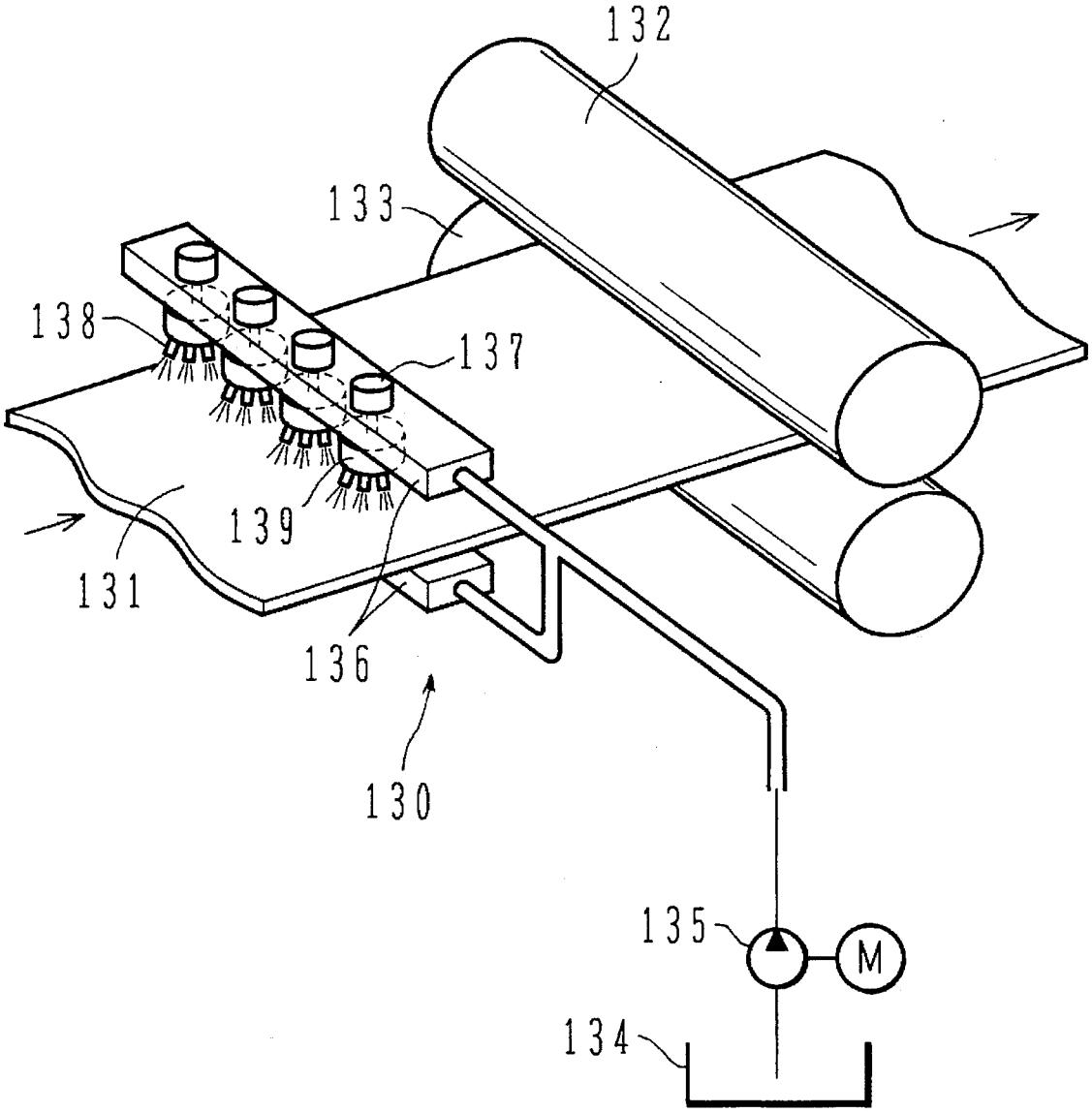
FIG. 13 is a view showing a high-pressure jet descaler having rotary nozzles, which is applicable to each of descaling apparatus in FIGS. 1 and 3.

As one example, a high-pressure jet descaler of rotary nozzle type as shown in FIG. 13 can be applied to the descaling apparatus. An illustrated high-pressure jet descaler 130 of rotary nozzle type is installed to face upper and lower surfaces of a strip 131 on the entry side of work rolls 132, 133. Descaling water from a descaling water tank 134 is pressurized by a high-pressure pump 135 to a level not less than 300 kg/cm$^2$, and the pressurized water is supplied to descaler headers 136. Each of the descaler headers 136 includes a nozzle header 139 to which a plurality of nozzles 138 rotatable by respective motors 137 are attached. The pressurized water supplied to each of the descaler headers 136 is ejected toward the corresponding surface of the strip 131 from the nozzles 138 which are attached to the nozzle header 139 and are rotating in a plane parallel to the surface of the strip 131, thereby removing scales deposited on the strip surfaces.

By thus ejecting the pressurized water toward the running strip 131 while rotating the nozzles 138, the pressurized water can be impinged upon scales from different angles for efficient descaling. In a conventional descaling apparatus using high-pressure jet water, the water pressure is about 200 kg/cm$^2$ and nozzles are fixed. By contrast, the high-pressure jet descaler of rotary nozzle type shown in FIG. 13 employs a higher water pressure and rotatable nozzle, and hence provides a superior descaling ability. In other words, scales are removed with a smaller flow rate of water under higher pressure to suppress a drop of the strip temperature as least as possible.

Figure 14:
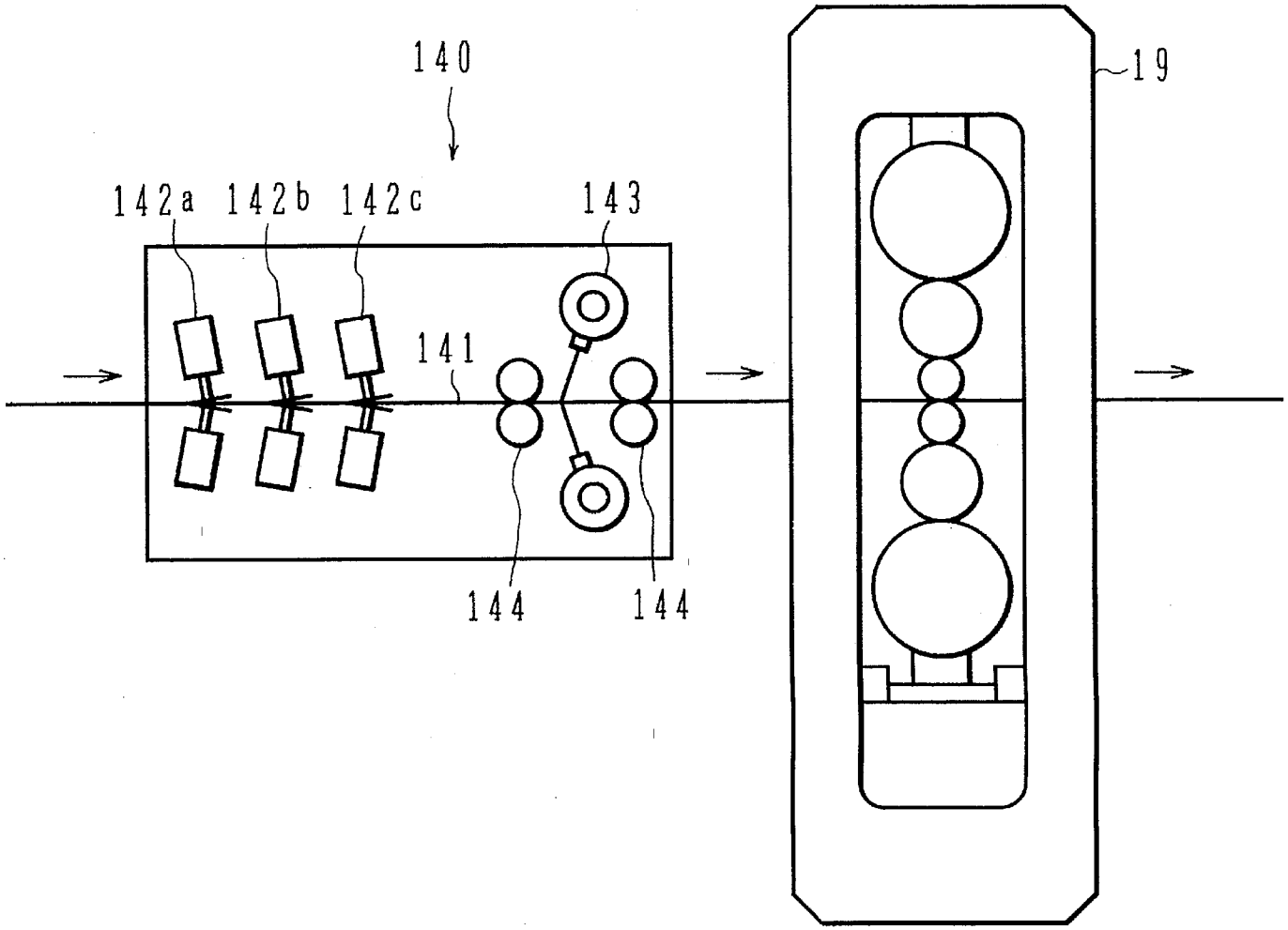
FIG. 14 is a view showing a disk rotary grinder which is applicable to each of the descaling apparatus in FIGS. 1 and 3.

As another example, a disk rotary grinding apparatus as shown in FIG. 14 can be applied to the descaling apparatus. An illustrated disk rotary grinding apparatus 140 includes disk grinders 142*a* to 142*c* for peeling off and removing scales on upper and lower surfaces of a strip 141 and a water jet unit 143 for removing peeled scales. The strip 141 removed scales is supplied to the finishing mill 19 by pitch rollers 144. The apparatus of FIG. 14 utilizes combined use of mechanical descaling by the disk grinders 142*a* to 142*c* and hydraulic descaling by the water jet unit 143, thereby ensuring positive removable of scales. Also, singe the disk grinders 142*a* to 142*c* can mechanically remove scales without using water, a temperature drop of the strip 141 can be prevented when those grinders are used solely.

Figure 15:
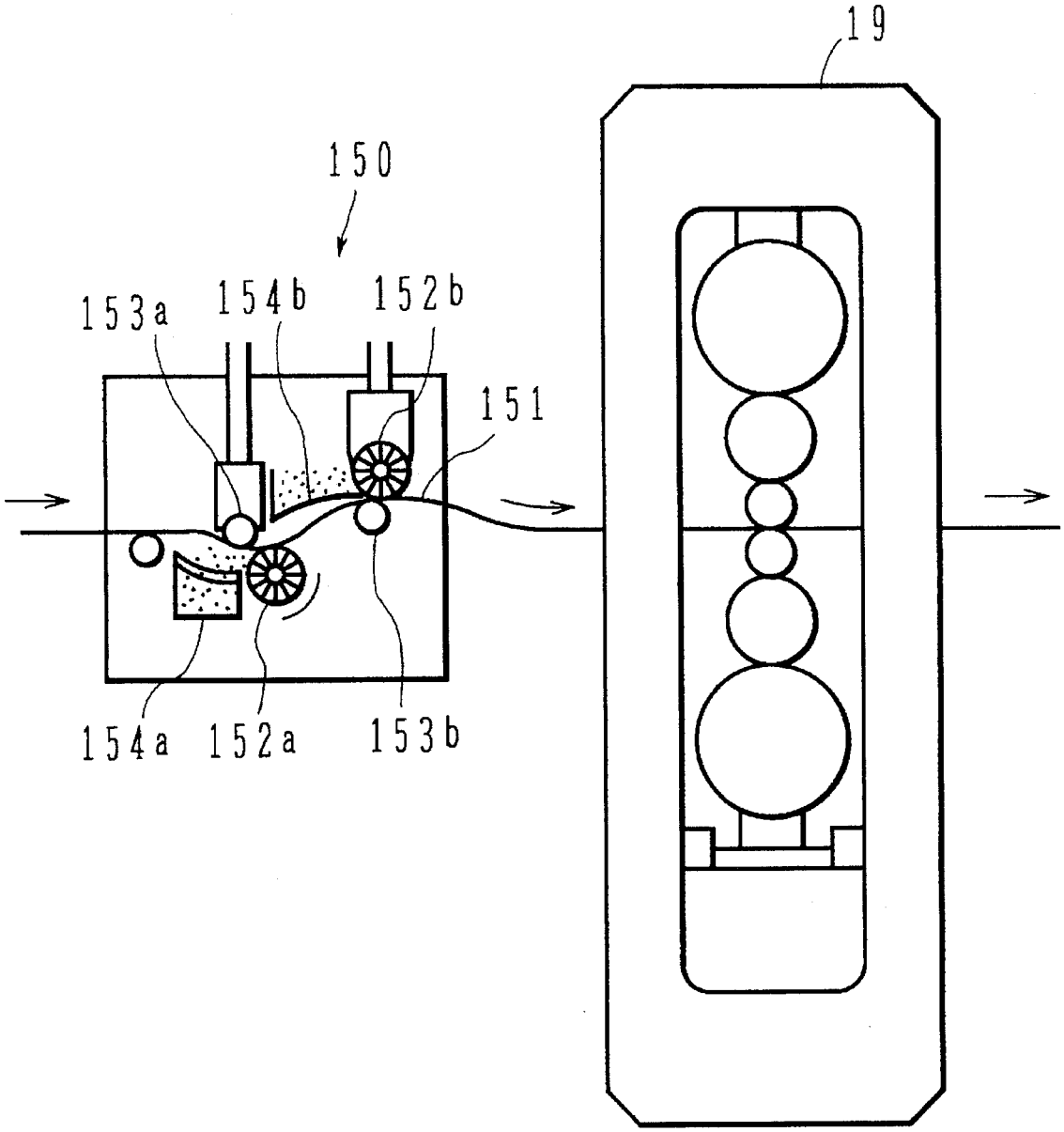
FIG. 15 is a view showing a rotary brush descaler which is applicable to each of the descaling apparatus in FIGS. 1 and 3.

As still another example, a rotary brush descaler as shown in FIG. 15 can be applied to the descaling apparatus. An illustrated rotary brush scaler 150 includes brush rolls 152*a*, 152*b* each comprising a heat-resistant brush, and bending rollers 153*a*, 153*b* positioned respectively to face the brush rolls 152*a*, 152*b*. As shown, the strip 151 is bent to cause cracks in scales generated on strip surfaces, and the cracked scales are removed by the brush rolls 153*a*, 153*b*. Recovery scale units 154*a*, 154*b* are disposed respectively near the brush rolls 153*a*, 153*b* for recovering the removed scales. Of course, a water jet unit may be combined with the descaler of FIG. 15.

With the embodiment described above, singe each of the finishing mills 19 to 21 employs the small-diameter work rolls having a diameter not larger than 500 mm, the strip can be finish-rolled at a high reduction rate. Hence since the finish rolling can be performed with the number of stands reduced to four or less, the finishing temperature of the strip 2*b* or 2*d* can be maintained at a predetermined value even under a low rolling speed. Also since the roughing mill 7 is constructed as a 4 H-twin mill, the distance between two stands is shortened so that the occurrence of scales and a drop of the strip temperature can be minimized. By using the small-diameter work rolls, it is possible to reduce the amount of heat absorbed by the work rolls from the strip and to prevent a drop of the strip temperature. Using the small-diameter work rolls in the roughing mill 7 is also suitable to construct the twin mill with a compact size. Additionally, the embodiment can manufacture both a thin plate and a thick plate.

With the embodiment, since the slab thickness is set to be not larger than 80 mm, the total number of stands including the roughing mill 7 and the finishing mills 19 to 21 can be reduced. In addition, as a result of the above-mentioned fact that the distance between two stands of the roughing mill 7 is shortened since it is constructed as a 4 H-twin mill, and the number of stands of the finishing mills 19 to 21 can be reduced to four or less, the strip can be finish-rolled at a low speed while suppressing a drop of the strip temperature and the occurrence of scales, a low rolling speed in match with the production scale required for the mini hot can be realized.

Further, since the total number of stands can be reduced by setting the slab thickness to be not larger than 80 mm, the size of the continuous casting machine 1 itself can be reduced and the entire plant can be made compact. In addition, since the plant is constructed as a through line from the continuous casting machine 1 to the carrousel coiler 14 or to the outlet of the transfer table 28, the distance from the continuous casting machine 1 to the carrousel coiler 14 or the distance from the continuous casting machine 1 to the outlet of the transfer table 28 can be set to a length not larger than 100 m. As a result, the plant can be made simple and compact. The through-line plant enables the temperature of molten steel to be utilized maximally, and hence contributes to a remarkable saving in consumption of energy.

Since the finishing mills 19 to 21 are each constructed as a rolling mill with intermediate rolls capable of shifting, a rolling mill with each pair of rolls crossed each other, a rolling mill using bottle-shaped rolls, or a rolling mill with work rolls capable of shifting, it is possible to compensate insufficiency in control of the strip crown and shape due to a lack of flexing rigidity of the small-diameter work rolls. Further, since the finishing mills 19 to 21 are each constructed as a cluster mill or a rolling mill with work rolls offset in the rolling direction relative to axes of back-up rolls, it is possible to solve the problem of horizontal flexing that is apt to easily occur when the small-diameter work rolls are used.

With the above-described embodiment, sound products can be manufactured without causing troubles and a deterioration in quality from the viewpoint of materials as well. More specifically, since a slab after being solidified can be held at a temperature not lower than 1100° C. for more than 1 minute at a casting speed of 2 to 5 m/minute before entering the rolling process, the slab can be rolled by the roughing mill 7 until a reduction rate as high as 40 to 50% without causing cracks in the bar. The steel structure becomes fine if the slab is rolled by the roughing mill 7 at a reduction of at least 10%. Therefore, even if the strip is rolled by the finishing mills 19 to 21 at a high reduction rate, no cracks are caused during the finish rolling, enabling the operation to be performed without any troubles. Although the finishing temperature is required to be kept in the range of about 820° to 920° C. corresponding to the transformation point of the strip, the embodiment can maintain such a range of the finishing temperature and achieve desired material characteristics.

Since the strip can be continuously manufactured from continuous casting to finish rolling without severing it midway, the need of threading operation which has been hitherto responsible for causing troubles such as buckling is eliminated, most of work requires no skill, and hence the operation is facilitated to improve the working efficiency. The continuous production also contributes to reducing off-gauge portions of the strip at its leading and trailing ends often caused by biting and bottom releasing in the past, and to improving an yield. Additionally, it is possible to manufacture a wide thin plate which has been difficult to roll in the past because of, e.g., load fluctuations incidental to biting and bottom releasing.

According to the present invention, since each of the finishing mills employs the small-diameter work rolls, the strip can be finish-rolled at a high reduction rate. Hence since the finish rolling can be performed with the number of stands reduced to four or less, the finishing temperature of the strip can be maintained at a required value even under a low rolling speed. Also since the roughing mill is constructed as a twin mill, the distance between two stands is shortened so that a drop of the strip temperature and the occurrence of scales can be minimized.

Since a slab being 80 mm or less thick is rolled in the plant including the continuous casting machine and the hot strip rolling mill directly combined with each other, low-speed rolling can be achieved while suppressing a drop of the strip temperature and the occurrence of scales, and the production scale can be reduced. The shortened plant length enables the plant space to become compact. Since a series of operations from casting to finish rolling are performed in a through line and the temperature of molten steel is maximally utilized, the present invention also contributes to a remarkable saving in consumption of energy.

Since the finishing mills are each constructed as a rolling mill with intermediate rolls capable of shifting, a rolling mill with each pair of rolls crossed each other, a rolling mill using bottle-shaped rolls, or a rolling mill with work rolls capable of shifting, it is possible to compensate insufficiency in control of the strip crown and shape due to a lack of flexing rigidity of the small-diameter work rolls. Further, since the finishing mills are each constructed as a cluster mill or a rolling mill with work rolls offset in the rolling direction relative to axes of back-up rolls, it is possible to solve the problem of horizontal flexing that is apt to easily occur when the small-diameter work rolls are used.

Additionally, according to the present invention, sound products can be manufactured without causing troubles and a deterioration in quality from the viewpoint of materials as well.

What is claimed is:

1. A hot strip rolling method directly combined with continuous casting, comprising the steps of casting a high-temperature slab with a thickness not larger than 80 mm by a continuous casting machine, carrying said slab directly to a roughing mill including plural sets of roll assemblies incorporated in one housing and arranged to successively roll said slab so that said slab is continuously rolled into a bar with a thickness of 20 to 60 mm by said roughing mill, and carrying said bar directly to a finishing mill comprised of three or four stands of hot strip rolling mills each including work rolls with a diameter not larger than 500 mm so that said bar is continuously rolled into a strip with a thickness not larger than 15 mm by said finishing mill.

2. A hot strip rolling method according to claim 1, wherein the temperature of the strip on a delivery side of the finishing mill is in the range of 820° to 920° C.

3. A hot strip rolling method according to claim 2, further comprising the step of heating said bar to the range of 1050° to 1200° C. between said roughing mill and said finishing mill.

4. A hot strip rolling method directly combined with continuous casting, comprising the steps of casting a high-temperature slab with a thickness not larger than 80 mm by a continuous casting machine, continuously rolling said slab into a bar with a thickness of 20 to 60 mm by a roughing mill including plural sets of roll assemblies incorporated in one housing and arranged to successively roll said slab, evenly heating said bar to the range of 1050° to 1200° C., and continuously rolling the heated bar into a strip with a thickness not larger than 15 mm by a finishing mill comprised of three or four stands of hot strip rolling mills each including work rolls with a diameter not larger than 500 mm.

5. A hot strip rolling method directly combined with continuous casting, comprising the steps of casting a high-temperature slab with a thickness not larger than 80 mm by a continuous casting machine, continuously rolling said slab into a bar with a thickness of 20 to 60 mm by a roughing mill, and continuously rolling said bar into a strip with a thickness not larger than 15 mm by a finishing mill comprised of three or four stands of hot strip rolling mills so that the rolling speed on the delivery side of the final stand of said finishing mill is not larger than 500 m/min.

6. A hot strip rolling method directly combined with continuous casting in which a slab cast by a continuous casting machine and having a thickness not larger than 80 mm is directly passed through a roughing mill and a finishing mill for hot rolling to produce a strip of a desired thickness, wherein:

a rolling mill including two sets of roll assemblies incorporated in one housing and arranged to successively roll said slab is employed as said roughing mill for rough-rolling said slab into a bar and, thereafter, a rolling mill train of four or less stands each including small-diameter work rolls is employed as said finishing mill for finish-rolling said bar at a high reduction rate and at a low speed.

7. A hot strip rolling method directly combined with continuous casting according to claim 6, wherein prior to the rough rolling by said roughing mill, said slab is heated by a first heater.

8. A hot strip rolling method directly combined with continuous casting according to claim 6, wherein prior to the finish rolling by said finishing mill, said bar cooled after the rough rolling is heated by a second heater.

9. A hot strip rolling method directly combined with continuous casting according to claim 6, wherein the rolling speed on the delivery side of said finishing mill is set to be not larger than 350 m/minute when said finishing mill comprises three stands, and not larger than 500 m/minute when said finishing mill comprises four stands.

10. A hot strip rolling method directly combined with continuous casting according to claim 6, wherein prior to the rough rolling by said roughing mill, scales generated on slab surfaces during casting are removed by a descaler.

11. A hot strip rolling method directly combined with continuous casting according to claim 6, wherein prior to the finish rolling by said finishing mill, scales generated on bar surfaces after the rough rolling are removed by a descaler.

12. A hot strip rolling plant directly combined with continuous casting, comprising a roughing mill including plural sets of roll assemblies incorporated in one housing and arranged to successively roll a high-temperature slab cast by a continuous casting machine, and a finishing mill comprised of three or four stands of hot strip rolling mills each including work rolls with a diameter not larger than 500 mm, wherein said high-temperature slab cast by said continuous casting machine has a thickness not larger than 80 mm, is directly carried to said roughing mill and said finishing mill, and is successively rolled by said roughing mill and said finishing mill in a continuous manner into a strip with a thickness not larger than 15 mm.

13. A hot strip rolling plant according to claim 12, wherein the temperature of the strip on a delivery side of the finishing mill is in the range of 820° to 920° C.

14. A hot strip rolling plant according to claim 13, wherein the strip is heated to the range of 1050° to 1200° C. between said roughing mill and said finishing mill.

15. A hot strip rolling plant directly combined with continuous casting, comprising:

a continuous casting machine for continuously casting a high-temperature slab with a thickness not larger than 80 mm, a roughing mill including plural sets of roll assemblies incorporated in one housing and arranged to successively roll said slab cast by said continuous casting machine into a bar with a thickness in the range of 20 to 60 mm, and a finishing mill comprised of three or four stands of 4-high or 6-high hot strip rolling mills each including work rolls with a diameter not larger than 500 mm and arranged to roll said bar rolled by said roughing mill, wherein a slab cast by said continuous casting machine is directly carried to said roughing mill and said finishing mill, and a material strip is successively rolled by said roughing mill and said finishing mill in a continuous manner so that the rolling speed on the delivery side of the final stand of said finishing mill is not larger than 500 m/minute, thereby manufacturing a product strip with a thickness not larger than 15 mm on the delivery side of the final stand of said finishing mill.

16. A hot strip rolling plant directly combined with continuous casting, wherein:

a continuous casting machine for continuously casting a high-temperature slab with a thickness not larger than 80 mm and a roughing mill of one stand including plural sets of roll assemblies incorporated in one housing and arranged to successively roll said slab cast by said continuous casting machine are disposed so that the distance from the installed position of said continuous casting machine to the middle position of said roughing mill is in the range of 10 to 15 m horizontally, a finishing mill comprised of three or four stands of 4-high or 6-high hot strip rolling mills each including work rolls with a diameter not larger than 500 mm, and arranged to successively roll a bar rolled by said roughing mill into a strip with a thickness not larger than 15 mm are disposed so that the distance from an inlet of the most upstream stand to an outlet of the final stand of said finishing mill is in the range of 10 to 15 m horizontally, and said continuous casting machine, said roughing mill, said finishing mill and a coiler disposed on the delivery side of the final stand of said finishing mill for coiling said strip are disposed so that the distance from said continuous casting machine to said coiler is not longer than 100 m horizontally.

17. A hot strip rolling plant directly combined with continuous casting in which a slab cast by a continuous casting machine and having a thickness not larger than 80 mm is directly passed through a roughing mill to produce a bar, and the bar is directly passed through a finishing mill for hot rolling to produce a strip of a desired thickness, wherein:

a rolling mill including two sets of roll assemblies incorporated in one housing and arranged to successively roll said slab is installed as said roughing mill, and a rolling mill train of four or less stands each including small-diameter work rolls is installed as said finishing mill.

18. A hot strip rolling plant directly combined with continuous casting according to claim 17, wherein said roughing mill includes small-diameter work rolls with a diameter not larger than 500 mm, and said work rolls are indirectly driven by back-up rolls or intermediate rolls.

19. A hot strip rolling plant directly combined with continuous casting according to claim 17, wherein each stand of said finishing mill includes the small-diameter work rolls with a diameter not larger than 500 mm, and said work rolls are indirectly driven by back-up rolls or intermediate rolls.

20. A hot strip rolling plant directly combined with continuous casting according to claim 17, wherein said roughing mill is a 4 H-twin mill including two sets of 4-high roll assemblies incorporated in one roll housing.

21. A hot strip rolling plant directly combined with continuous casting according to claim 17, wherein said roughing mill is a 2 H-twin mill including two sets of 2-high roll assemblies incorporated in one roll housing.

22. A hot strip rolling plant directly combined with continuous casting according to claim 17, further comprising, on the entry side of said roughing mill, a first heater for heating body surfaces and edge portions of said slab over-cooled with heat radiation after casting.

23. A hot strip rolling plant directly combined with continuous casting according to claim 22, further comprising, on the delivery side of said first heater and on the entry side of said roughing mill, a descaler for removing scales generated on slab surfaces during casting.

24. A hot strip rolling plant directly combined with continuous casting according to claim 22, wherein the distance between an outlet of said first heater and a roll biting position of said roughing mill is not longer than 3 m.

25. A hot strip rolling plant directly combined with continuous casting according to claim 17, further comprising, between said roughing mill and said finishing mill, a second heater for heating the bar cooled after rough rolling.

26. A hot strip rolling plant directly combined with continuous casting according to claim 25, further comprising, on the delivery side of said second heater and on the entry side of said finishing mill, a descaler for removing scales generated on bar surfaces after rough rolling.

27. A hot strip rolling plant directly combined with continuous casting according to claim 25, wherein the distance between an outlet of said second heater and a first roll biting position of said finishing mill is not longer than 5 m.

28. A hot strip rolling plant directly combined with continuous casting according to claim 17, wherein said finishing mill is a rolling mill for rolling the rough-rolled bar into a thin plate with a thickness not larger than 15 mm.

29. A hot strip rolling plant directly combined with continuous casting according to claim 28, further comprising, downstream of said finishing mill, a cooler for cooling said strip rolled by said finishing mill, a shear for dividing the cooled strip, and a coiler for reeling up the divided strip into a coil.

30. A hot strip rolling plant directly combined with continuous casting according to claim 29, wherein the length from said continuous casting machine to said coiler is not larger than 100 m.

31. A hot strip rolling plant directly combined with continuous casting according to claim 29, wherein said coiler is a carrousel coiler.

32. A hot strip rolling plant directly combined with continuous casting according to claim 21, wherein said finishing mill is a rolling mill for rolling the rough-rolled bar into a thick plate with a thickness not larger than 40 mm.

33. A hot strip rolling plant directly combined with continuous casting according to claim 32, further comprising, on the delivery side of said roughing mill, a shear for severing crop portions of said bar at leading and tailing ends thereof after rough rolling and for dividing said bar.

34. A hot strip rolling plant directly combined with continuous casting according to claim 32, further comprising, downstream of said finishing mill, a cooler for cooling said strip rolled by said finishing mill, a shear for dividing the cooled strip, and a transfer table for feeding the divided strip to a refining yard.

35. A hot strip rolling plant directly combined with continuous casting according to claim 34, wherein the length from said continuous casting machine to said transfer table is not larger than 100 m.

36. A hot strip rolling plant directly combined with continuous casting according to claim 17, wherein said finishing mill is a rolling mill including a roll bending apparatus associated with at least one of work rolls and intermediate rolls for adjusting a roll deflection to control a crown of the strip.

37. A hot strip rolling plant directly combined with continuous casting according to claim 36, wherein said rolling mill is a rolling mill with intermediate rolls capable of shifting in the axial direction thereof.

38. A hot strip rolling plant directly combined with continuous casting according to claim 17, wherein said rolling mill is a rolling mill including a pair of upper work roll and upper back-up roll and a pair of lower work roll and lower back-up roll, said pair of upper work roll and upper back-up roll and said pair of lower work roll and lower back-up roll being crossed with each other for control of a crown of the strip.

39. A hot strip rolling plant directly combined with continuous casting according to claim 17, wherein sad finishing mill is a 6-high mill including work rolls, intermediate rolls and back-up rolls, at least one of said rolls being of deformed rolls defined by contour curves which are asymmetrical about the pass center of said mill and are vertically symmetrical about a point, said deformed rolls being movable in the axial direction thereof to change a gap profile between the rolls.

40. A hot strip rolling plant directly combined with continuous casting according to claim 17, wherein said finishing mill is a 4-high mill including work rolls and back-up rolls, at least one of said rolls being of deformed rolls defined by contour curves which are asymmetrical about the pass center of said mill and are vertically symmetrical about a point, said deformed rolls being movable in the axial direction thereof to change a gap profile between the rolls.

41. A hot strip rolling plant directly combined with continuous casting according to claim 17, wherein said finishing mill is a rolling mill with work rolls capable of shifting in the axial direction thereof so that changes in a roll gap due to wear of said work rolls is reduced.

42. A hot strip rolling plant directly combined with continuous casting according to claim 17, wherein said finishing mill is a cluster mill with each of work rolls supported by a plurality of back-up rolls.

43. A hot strip rolling plant directly combined with continuous casting according to claim 17, wherein said finishing mill is a rolling mill with axes of upper and lower work rolls offset from axes upper and lower intermediate rolls or upper and lower back-up rolls toward the delivery side in the rolling direction so that driving tangential forces applied to said work rolls are canceled by horizontal components of rolling load applied to said work rolls.

44. A hot strip rolling plant directly combined with continuous casting according to claim 17, wherein a roll cooler comprising a multiplicity of nozzles for ejecting cooling water toward a roll, covers for preventing the cooling water from scattering and leaking, sealing means for tightly sealing gaps between a roll surface and said covers, and recovery means for recovering the cooling water after being ejected to cool said roll is installed for each of the work rolls of at least one stand of said finishing mill.

45. A hot strip rolling plant directly combined with continuous casting according to claim 17, wherein a roll grinder for grinding the work rolls under rolling online is installed for the work rolls of said roughing mill and at least one stand of said finishing mill.

46. A hot strip rolling plant directly combined with continuous casting according to claim 23, wherein said descaler is a high-pressure jet descaler of rotary nozzle type for ejecting water under high pressure from rotary nozzles and removing scales.

47. A hot strip rolling plant directly combined with continuous casting according to claim 23, wherein said descaler is a disk rotary grinder or a rotary brush descaler using heat-resistant brushes for mechanically removing scales.

48. A hot strip rolling plant directly combined with continuous casting according to claim 17, wherein said rolling mill is a rolling mill including an upper work roll, an upper back-up roll, a lower work roll, and a lower back-up roll, and wherein axes of said upper work roll and said upper back-up roll are obliquely oriented with respect to axes of said lower work roll and said lower back-up roll such that the axes cross when projected on a horizontal plane, in order to control a crown of the strip.

* * * * *